US009623551B1

(12) United States Patent
Bowen et al.

(10) Patent No.: US 9,623,551 B1
(45) Date of Patent: Apr. 18, 2017

(54) AUTOMOTIVE CREEPER AND A MECHANICS CHAIR ASSEMBLY INCLUDING THE SAME

(71) Applicants: Craig Eugene Bowen, Lancaster, OH (US); Richard Mark Spring, Lancaster, OH (US)

(72) Inventors: Craig Eugene Bowen, Lancaster, OH (US); Richard Mark Spring, Lancaster, OH (US)

( * ) Notice: Subject to any disclaimer, the term of this patent is extended or adjusted under 35 U.S.C. 154(b) by 0 days.

(21) Appl. No.: 14/846,941

(22) Filed: Sep. 7, 2015

Related U.S. Application Data

(63) Continuation-in-part of application No. 14/164,430, filed on Jan. 27, 2014, now Pat. No. 9,126,326.

(60) Provisional application No. 61/757,680, filed on Jan. 28, 2013.

(51) Int. Cl.
*B25H 5/00* (2006.01)
*A47C 1/00* (2006.01)

(52) U.S. Cl.
CPC *B25H 5/00* (2013.01); *A47C 1/00* (2013.01)

(58) Field of Classification Search
CPC ..... B25H 5/00; B25H 5/0083
USPC ..... 280/32.6
See application file for complete search history.

(56) References Cited

U.S. PATENT DOCUMENTS 2,051,563 A * 8/1936 Mance ..... B25H 5/00 280/32.6
2,210,585 A * 8/1940 Hulbert ..... B25H 5/00 188/5
2,614,271 A * 10/1952 Neil ..... B25H 5/00 280/32.6
2,703,717 A * 3/1955 Miller ..... B25H 5/00 280/32.6
3,243,230 A * 3/1966 Otto ..... A45B 11/00 135/90
4,889,352 A * 12/1989 Chamberlin, Jr. ..... B25H 5/00 280/30
4,986,558 A 1/1991 Morris
5,378,003 A 1/1995 Burd et al.
(Continued)

OTHER PUBLICATIONS

First office action on the merits (Non-Final Rejection) in U.S. Appl. No. 14/164,430, mailed on Jan. 13, 2015.
(Continued)

*Primary Examiner* — J. Allen Shriver, II
*Assistant Examiner* — Brian Cassidy
(74) *Attorney, Agent, or Firm* — The Law Office of Patrick F. O'Reilly III, LLC

(57) ABSTRACT

An automotive creeper is disclosed herein. The automotive creeper includes a plurality of spaced-apart longitudinal frame members extending in a lengthwise direction of the automotive creeper; a plurality of spaced-apart, transverse frame members connected to each of the plurality of spaced-apart longitudinal frame members, at least one of the plurality of spaced-apart, transverse frame members including an open end that is configured to receive a support member of an automotive creeper accessory device inserted therein; and a body pad supported on one or more of the plurality of spaced-apart, transverse frame members, the body pad configured to accommodate a torso of a user resting thereon. A mechanics chair assembly that includes a mechanics chair and the automotive creeper is also disclosed herein.

21 Claims, 42 Drawing Sheets

(56) References Cited

U.S. PATENT DOCUMENTS 5,494,305 A 2/1996 Chen
5,503,415 A 4/1996 Powell
5,624,126 A 4/1997 Vosbikian et al.
D384,466 S * 9/1997 Taylor ..... D34/23
5,790,997 A * 8/1998 Ruehl ..... A47C 17/162 297/316
5,868,461 A * 2/1999 Brotherston ..... A47C 17/1756 297/325
D406,432 S 3/1999 Taylor et al.
D406,433 S 3/1999 Taylor et al.
D406,683 S 3/1999 Taylor et al.
D406,684 S 3/1999 Pool et al.
6,082,813 A * 7/2000 Chen ..... A47C 4/286 297/16.1
6,105,719 A * 8/2000 Lensing ..... B25H 5/00 182/116
6,199,877 B1 * 3/2001 Shockley ..... B25H 5/00 280/32.6
6,238,069 B1 5/2001 Miles
6,250,712 B1 * 6/2001 Livington ..... A47C 1/146 297/129
6,371,496 B1 4/2002 Balolia
6,412,862 B1 * 7/2002 Dickerson ..... A47C 7/70 297/161
6,425,590 B1 * 7/2002 Whiteside ..... B25H 5/00 280/32.5
6,540,378 B2 4/2003 Alsup
6,578,857 B1 * 6/2003 Whiteside ..... B25H 5/00 280/32.5
6,641,146 B2 * 11/2003 Reese ..... B25H 5/00 182/116
6,824,149 B1 * 11/2004 Whitlock ..... B25H 5/00 280/32.6
6,834,868 B1 * 12/2004 Blackburn ..... B25H 5/00 280/32.6
6,871,861 B2 * 3/2005 Hernandez, Jr. ..... B25H 5/00 248/129
6,908,154 B2 * 6/2005 Aono ..... A61G 5/006 280/650
6,966,564 B2 * 11/2005 Hernandez, Jr. ..... B25H 5/00 248/129
6,969,077 B2 * 11/2005 Liu ..... B25H 5/00 280/30
7,025,421 B1 * 4/2006 Fowler ..... A47C 1/026 297/325
7,032,907 B1 4/2006 Marsh
7,032,908 B2 4/2006 Melvin
7,273,215 B1 9/2007 Smith
7,374,181 B1 5/2008 Wu
7,434,817 B2 10/2008 Rush
7,481,438 B2 * 1/2009 Hernandez ..... B25H 5/00 280/32.5
8,056,908 B2 * 11/2011 Scott ..... B25H 5/00 280/32.6
8,186,755 B2 * 5/2012 Lovley ..... A47C 7/66 135/119
8,632,231 B1 * 1/2014 McCullough ..... B25H 5/00 280/32.6
8,746,708 B2 * 6/2014 Wang ..... B25H 5/00 280/32.6
9,061,413 B2 * 6/2015 Huang ..... B25H 5/00
9,193,064 B2 * 11/2015 Dall'Armi ..... B25H 5/00
2003/0163872 A1 * 9/2003 Hsin ..... A47C 19/12 5/621
2004/0227313 A1 * 11/2004 Shockley ..... B25H 5/00 280/32.6
2006/0192355 A1 * 8/2006 Hulden ..... B25H 5/00 280/32.6
2006/0285404 A1 12/2006 Alexander
2007/0013154 A1 * 1/2007 Staples ..... B25H 5/00 280/32.6
2007/0080510 A1 * 4/2007 Ji ..... B25H 5/00 280/32.6
2008/0157492 A1 * 7/2008 Chaykin ..... B25H 5/00 280/32.6
2008/0290699 A1 * 11/2008 Golias ..... A47D 1/002 297/16.1
2010/0079985 A1 4/2010 Prosey
2010/0123293 A1 5/2010 Benjamin
2011/0063821 A1 3/2011 Prosey
2011/0227303 A1 9/2011 Gering
2012/0235371 A1 * 9/2012 Smith ..... B25H 5/00 280/32.6
2013/0119626 A1 * 5/2013 Haut ..... B62B 9/245 280/47.38
2014/0027990 A1 * 1/2014 Triglia ..... F21V 33/0084 280/32.6
2014/0259410 A1 * 9/2014 Zerhusen ..... A61G 7/00 5/600

OTHER PUBLICATIONS

Notice of Allowance in U.S. Appl. No. 14/164,430, mailed on May 1, 2015.

* cited by examiner

AUTOMOTIVE CREEPER AND A MECHANICS CHAIR ASSEMBLY INCLUDING THE SAME

CROSS-REFERENCE TO RELATED APPLICATIONS

This is a continuation-in-part of U.S. patent application Ser. No. 14/164,430, entitled "Attachment Device For An Automotive Creeper And Mechanics Chair Using The Same", filed on Jan. 27, 2014, and further claims the benefit of U.S. Provisional Patent Application No. 61/757,680, entitled "Attachment Device For An Automotive Creeper And Mechanics Chair Using The Same", filed on Jan. 28, 2013, the disclosure of each of which is hereby incorporated by reference as if set forth in their entirety herein.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to an automotive creeper and a mechanics chair assembly including the same. More particularly, the invention relates to automotive creepers, and a mechanics chair that is designed to be used with the automotive creepers.

2. Background and Description of Related Art

Mechanics often use creepers to service the undercarriage of vehicles. Some sort of light source must be used. Mechanics are often working in tight spaces and may need to hold a light while holding other tools. If lights with cords are used, the cords may get in the way and get caught on the creeper wheels. This repair process often makes it hard to shine light on the spot needed to complete the repair. The same problem of light applies to the mechanics chair. Also, the typical mechanics chair is very easy to tip over backwards.

In addition, conventional creepers are designed to have a standard length, which does not comfortably accommodate all individuals that use them. In particular, relatively tall individuals are normally uncomfortable when using a conventional creeper because their head and neck area are disposed well beyond the head end of the creeper when laying thereon. As a result, taller individuals often experience neck fatigue and discomfort, especially when utilizing a conventional creeper for an extended period of time. Also, conventional creepers are not designed with the ergonomics of the user in mind.

Therefore, what is needed is an automotive creeper that is ergonomically designed so as to enhance the comfort of a user while he or she is working on a vehicle. Moreover, an automotive creeper is needed that is readily capable of accommodating accessory devices, such as a headrest and/or lights. Furthermore, there is a need for a mechanics chair, which does not easily tip over, and provides increased back and neck support during use so that user fatigue and discomfort can be minimized during vehicle repairs. In addition, an attachment device is needed that can be quickly and easily attached to automotive creepers of varying size so that accessories, such as a headrest and/or lights, may be simply attached thereto. Also, an attachment device is needed that is capable of increasing the user comfort associated with automotive creepers, particularly for individuals having a taller stature.

BRIEF SUMMARY OF EMBODIMENTS OF THE INVENTION

Accordingly, the present invention is directed to an automotive creeper and a mechanics chair assembly including the same, which substantially obviates one or more problems resulting from the limitations and deficiencies of the related art.

In accordance with one or more embodiments of the present invention, there is provided an automotive creeper that includes a plurality of spaced-apart longitudinal frame members extending in a lengthwise direction of the automotive creeper; a plurality of spaced-apart, transverse frame members connected to each of the plurality of spaced-apart longitudinal frame members, at least one of the plurality of spaced-apart, transverse frame members including an open end that is configured to receive a support member of an automotive creeper accessory device inserted therein; and a body pad supported on one or more of the plurality of spaced-apart, transverse frame members, the body pad configured to accommodate a torso of a user resting thereon.

In a further embodiment of the present invention, the plurality of spaced-apart longitudinal frame members comprises a first longitudinal side frame member and a second longitudinal side frame member, the second longitudinal side member of the automotive creeper being disposed generally opposite to the first longitudinal side member of the automotive creeper.

In yet a further embodiment, each of the plurality of spaced-apart, transverse frame members is disposed generally perpendicular to the first longitudinal side frame member and the second longitudinal side member.

In still a further embodiment, at least some of the plurality of spaced-apart, transverse frame members are disposed underneath the first and second longitudinal side frame members such that the first and second longitudinal side frame members are supported thereon.

In yet a further embodiment, the plurality of spaced-apart transverse frame members comprises a first transverse frame member disposed at a head end of the automotive creeper, a second transverse frame member disposed at a foot end of the automotive creeper, and one or more intermediate transverse frame members disposed between the first transverse frame member and the second transverse frame member, and wherein the first transverse frame member is connected to respective head ends of the first and second longitudinal side frame members.

In still a further embodiment, the automotive creeper further comprises a headrest supported on a generally T-shaped member, the generally T-shaped member being attached to the first transverse frame member at the head end of the automotive creeper.

In yet a further embodiment, an angle of the headrest is selectively adjustable by a user.

In still a further embodiment, the first and second longitudinal side frame members are each bent at an angle near the head end of the automotive creeper so as to accommodate an inclined head position of the user disposed on the automotive creeper.

In yet a further embodiment, each of the first and second longitudinal side frame members comprises one or more wheels coupled thereto, the one or more wheels configured to allow the automotive creeper to be rolled along the ground.

In still a further embodiment, the automotive creeper further comprises one or more light emitting devices for providing light to an area of a vehicle being serviced.

In yet a further embodiment, the one or more light emitting devices comprise light emitting diode (LED) lamps.

In still a further embodiment, the automotive creeper further comprises a tool tray, the tool tray including an outwardly extending frame member, wherein the open end of the at least one of the plurality of spaced-apart, transverse frame members receives a portion of the outwardly extending frame member of the tool tray therein so that the tool tray is capable of being detachably coupled to the automotive creeper.

In accordance with one or more other embodiments of the present invention, there is provided an automotive creeper that includes a plurality of spaced-apart longitudinal frame members extending in a lengthwise direction of the automotive creeper, the plurality of spaced-apart longitudinal frame members including a first longitudinal side frame member and a second longitudinal side frame member, the second longitudinal side member of the automotive creeper being disposed generally opposite to the first longitudinal side member of the automotive creeper; a plurality of spaced-apart, transverse frame members connected to each of the plurality of spaced-apart longitudinal frame members, the plurality of spaced-apart transverse frame members including a first transverse frame member disposed at a head end of the automotive creeper, a second transverse frame member disposed at a foot end of the automotive creeper, and one or more intermediate transverse frame members disposed between the first transverse frame member and the second transverse frame member, the first transverse frame member being connected to respective head ends of the first and second longitudinal side frame members, and at least one of the plurality of spaced-apart, transverse frame members including an open end that is configured to receive a support member of an automotive creeper accessory device inserted therein; a body pad supported on one or more of the plurality of spaced-apart, transverse frame members, the body pad configured to accommodate a torso of a user resting thereon; and a headrest supported on a generally T-shaped member, the generally T-shaped member being attached to the first transverse frame member at the head end of the automotive creeper.

In accordance with yet one or more other embodiments of the present invention, there is provided a mechanics chair assembly comprising a mechanics chair, which includes: a seat portion, the seat portion including a plurality of seat members, a first of the plurality of seat members being laterally spaced apart from a second of the plurality of seat members; a seat back portion coupled to the seat portion, the seat back portion including a plurality of seat back members, a first of the plurality of seat back members being laterally spaced apart from a second of the plurality of seat back members; a base portion, the base portion including a plurality of base members, a first of the plurality of base members being laterally spaced apart from a second of the plurality of base members, at least one of the plurality of base members extending beyond the seat back portion of the mechanics chair so as to prevent the tipping thereof; and a leg structure coupling the seat portion to the base portion, the leg structure including a plurality of generally vertical leg members, each of the plurality of generally vertical leg members spaced apart from one another, a first of the plurality of generally vertical leg members coupling the first of the plurality of base members to the first of the plurality of seat members, and a second of the plurality of generally vertical leg members coupling the second of the plurality of base members to the second of the plurality of seat members.

In a further embodiment of the present invention, the plurality of seat members comprise a first pair of seat side members and a second pair of transverse seat members, the seat side members being spaced apart from one another by the length of the transverse seat members; and wherein each of the seat side members is disposed generally perpendicular to each of the transverse seat members.

In yet a further embodiment, the plurality of seat back members comprise a pair of seat back side members and a transverse seat back member, the seat back side members being spaced apart from one another by the length of the transverse seat back member; and wherein each of the seat back side members is disposed generally perpendicular to the transverse seat back member.

In still a further embodiment, the plurality of base members comprises a pair of base side members and a transverse base member, the base side members being spaced apart from one another by the length of the transverse base member; wherein each of the base side members is disposed generally perpendicular to the transverse base member; and wherein each of the base side members comprises a plurality of wheels coupled thereto, at least one of the plurality of wheels on the each base side member being disposed rearwardly of the seat back portion of the mechanics chair so as to prevent the tipping thereof.

In yet a further embodiment, the mechanics chair of the mechanics chair assembly further comprises a pair of diagonal members, a first of the pair of the diagonal members coupling the first of the plurality of generally vertical leg members to the first of the plurality of seat members, and a second of the pair of the diagonal members coupling the second of the plurality of generally vertical leg members to the second of the plurality of seat members; and wherein the seat portion of the mechanics chair further comprises a padded seat.

In still a further embodiment, the mechanics chair assembly further comprises an automotive creeper coupled to the seat back portion of the mechanics chair by means of at least one pair of laterally spaced-apart hook members, a first of the at least one pair of hook members being attached to the first of the plurality of seat back members, and a second of the at least one pair of hook members being attached to the second of the plurality of seat back members. The automotive creeper includes a plurality of spaced-apart longitudinal frame members extending in a lengthwise direction of the automotive creeper; a plurality of spaced-apart, transverse frame members connected to each of the plurality of spaced-apart longitudinal frame members, at least one of the plurality of spaced-apart, transverse frame members including an open end that is configured to receive a support member of an automotive creeper accessory device inserted therein; and a body pad supported on one or more of the plurality of spaced-apart, transverse frame members, the body pad configured to accommodate a torso of a user resting thereon. In this further embodiment, the at least one pair of hook members of the mechanics chair is coupled to a first one of the plurality of spaced-apart, transverse frame members of the automotive creeper.

In yet a further embodiment, the mechanics chair assembly further comprises a support bar subassembly configured to support one end of the automotive creeper when the automotive creeper is disposed in a generally horizontal position on the mechanics chair, the support bar subassembly configured to extend diagonally from one of the plurality of base members of the mechanics chair to a second one of the plurality of spaced-apart, transverse frame members of the automotive creeper.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
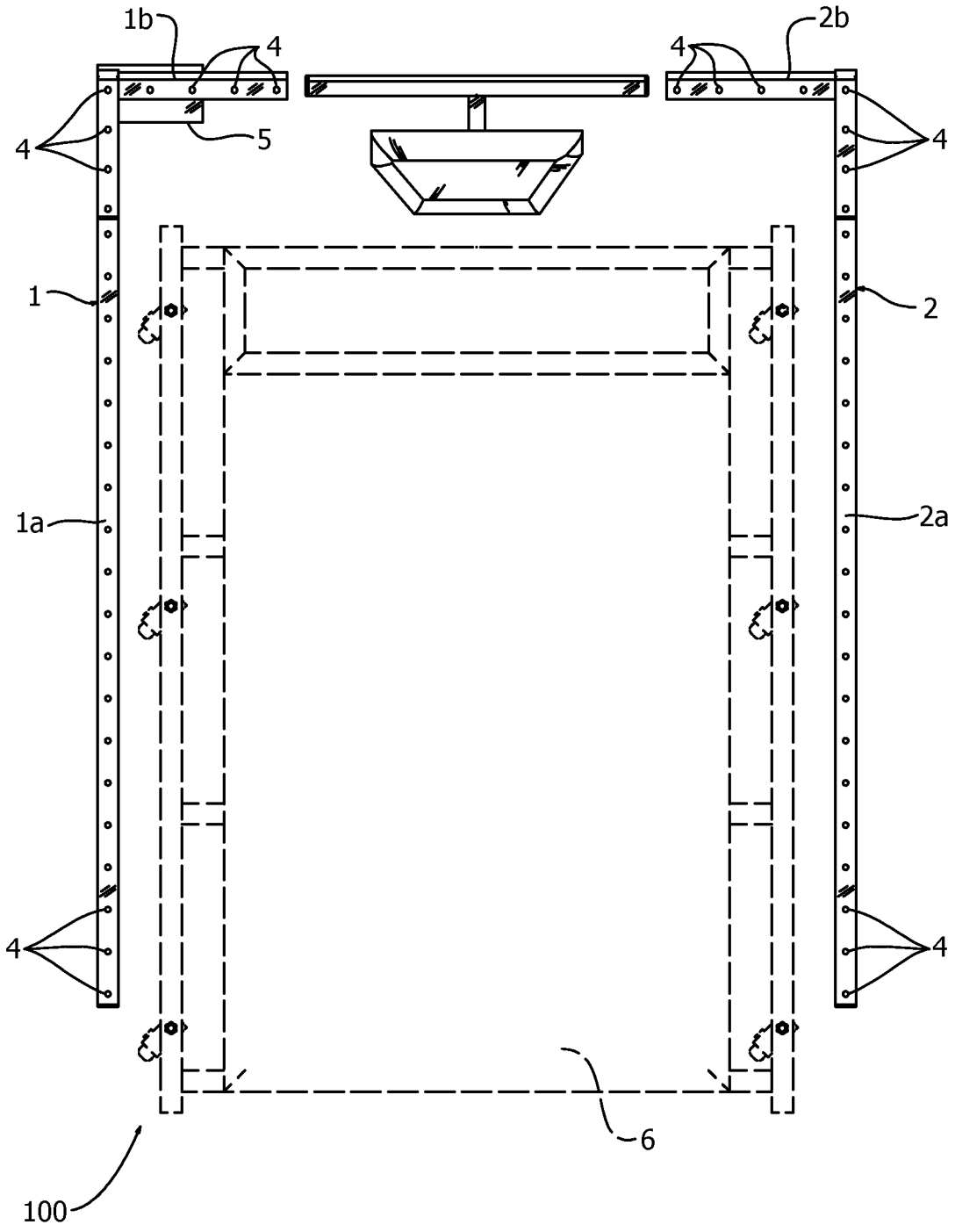
FIG. 1 is a top view of the attachment device disposed adjacent to an automotive creeper, according to an embodiment of the invention.

A first embodiment of the attachment device is seen generally at 100 in FIG. 1. As shown in this figure, the attachment device 100 is adapted to attach to an automotive creeper 6, which is illustrated in FIGS. 1-5 using dashed lines only to indicate that the attachment device 100 is capable of being attached to multiple creepers. The attachment device 100 generally comprises a first generally L-shaped member 1 (e.g., left side bar 1) and a second generally L-shaped member 2 (e.g., right side bar 2), both of which attach to respective sides of the creeper 6 by means of C-clamps. The two halves 1, 2 of the attachment device 100 connect together at a location 3 (see e.g., FIG. 2), which is in the form of an adjustable joint. The adjustable joint is designed to permit both members 1, 2 to slide in and out such that creepers having various widths may be readily accommodated. While many conventional creepers have a standard width of seventeen (17) inches, the adjustable joint of the attachment device 100 enables it to fit conventional creepers having widths that are larger and smaller than the standard seventeen (17) inch width.

In one embodiment, each of the generally L-shaped members 1, 2 is in the form of a tubular member having a generally square cross-section and a hollow core or interior. However, it is to be understood that other suitable cross-sectional shapes could be used for the generally L-shaped members 1, 2, such as rectangular or circular.

As shown in FIG. 1, the top of each generally L-shaped member 1, 2 may be provided with a plurality of light emitting devices 4 disposed along the length thereof. For example, the light emitting devices 4 may comprise small light-emitting diode (LED) type lamps that are inserted into the top surface of each generally L-shaped member 1, 2, and spaced apart along the entire length of each generally L-shaped member 1, 2. While individual LED lamps are depicted in the illustrated embodiment, it is to be understood that LED light strips could also be used. For added protection, the LED lights could be encased in metal holders or housings installed on each generally L-shaped member 1, 2. In addition, the light emitting devices 4 could be embodied in other forms as well, such as incandescent lamps, compact fluorescent lamps (CFLs), etc. Because the attachment device 100 accommodates lights directly thereon, it makes it possible for the mechanic to perform hands free service to the undercarriage or sides of an automobile without the hassle of holding a light. Preferably, the wiring for the light emitting devices 4 is run inside the hollow cavity of the generally L-shaped members 1, 2 (i.e., if the generally L-shaped members are provided in the form of tubular members). Because the light emitting devices 4 are mounted on the generally L-shaped members 1, 2, which are disposed around the periphery of the creeper 6, they are positioned out of the way, and not directly in the area where vehicle repairs are being performed. In addition, because the lights 4 of FIG. 1 extend generally the full length of each side of the creeper 6, and not just in the head area of the creeper 6, they are able to more fully illuminate the vehicle work area.

Advantageously, the light emitting devices 4 (e.g., bright LED lights) illuminate the area where the mechanic is working. As the mechanic moves the creeper, the lights will move with him. The entire work area is illuminated as opposed to a small area illuminated with conventional handheld lights. Energy efficiency can be greatly enhanced by using LED lights. For example, the LED lights use approximately 70% less energy than fluorescent or incandescent bulbs. Also, the LED lights have a longer bulb life. The LED lamps will burn for approximately 100,000+ hours, whereas fluorescent lamps last, for example, approximately 20,000+ hours. In addition, the LED lights operate cooler than other lamps. This is safer and particularly helpful in cramped spaces where the temperature can rise quickly. If and when it is needed, the LED lights are cheaper to repair/replace than buying a new lighting system. The LED lights can also be made to be water-resistant.

In the illustrated embodiment, the light emitting devices 4 are powered by a 12V rechargeable battery pack disposed in a battery container 5, and the lights 4 are turned "on" and "off" by an appropriate switch electrically coupled thereto. When needed, a standard power cord could be used to recharge the battery pack while it is attached to the creeper 6. Alternatively, or in addition to, non-stop work could be performed with extra battery packs charged and ready for quick replacement. Preferably, the battery pack is relatively compact and lightweight in construction so as not to significantly increase the overall weight of the creeper. In one embodiment, the battery container 5 is mounted behind the headrest so that it is out of the way, but those of ordinary skill in the art will appreciate that the battery container 5 could be mounted in various other suitable locations on the generally L-shaped members 1, 2 as well. Preferably, the battery container 5 will also include a 12V accessory jack provided thereon. This accessory jack could supply power to ultraviolet (UV) lights or to additional handheld lighting. For example, a six (6) inch, detachable handheld light could be attached with clips to the top of one of the generally L-shaped members 1, 2. If the need arises for the use of such additional or specialized UV lights, the accessory jack allows the mechanic to power the object without crawling out from under the vehicle to plug in the item. The 12V accessory jack could also power other items that use a 12V power source. For example, speakers could be added in the corners of the generally L-shaped members 1, 2. This would allow music or instructional recordings to be played while the mechanic is performing a repair. Preferably, the rechargeable battery pack powers the light emitting devices 4, the 12V accessory jack, and the optional, detachable handheld light.

Figure 2:
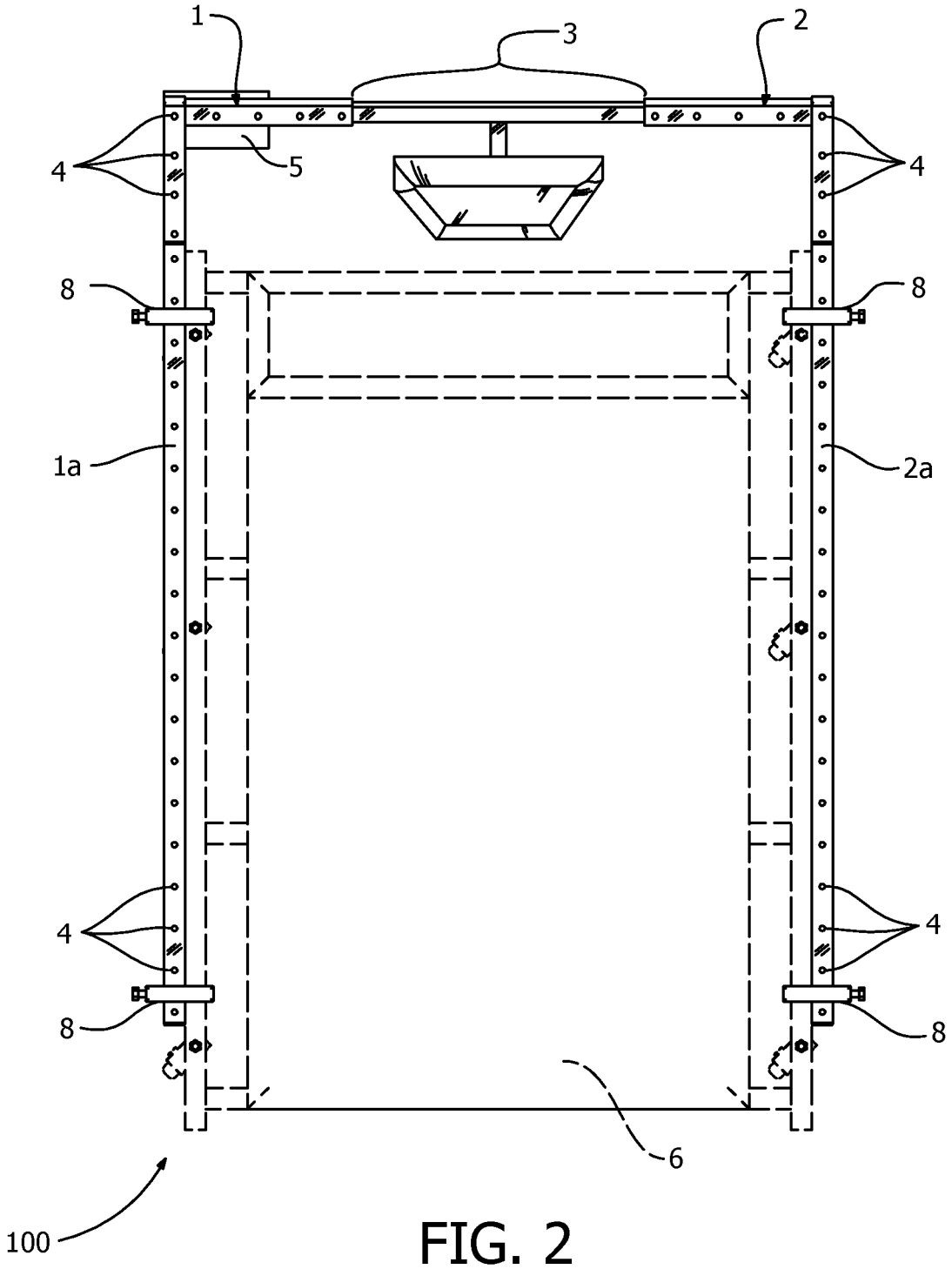
FIG. 2 is a top view of the attachment device attached to an automotive creeper, according to an embodiment of the invention.

In FIG. 2, the attachment device 100 is shown attached to an automotive creeper 6. In particular, both generally L-shaped members 1, 2 are attached together at the head end joint 3, and each generally L-shaped member 1, 2 is connected snuggly to a respective side (e.g., to a respective side rail or bar) of the automotive creeper 6 by means of a plurality of C-clamps 8. Preferably, when each generally L-shaped member 1, 2 is attached to a respective side bar of the automotive creeper 6, the top and bottom surfaces of each side bar portion 1*a*, 2*a* of each generally L-shaped member 1, 2 is disposed generally parallel to the respective top and bottom surfaces of each creeper side bar. In one embodiment, the head end joint 3 of the attachment device 100 is located proximate to and/or behind the headrest of the device 100. While each of the generally L-shaped members 1, 2 is connected to its respective side of the automotive creeper 6 by means of two C-clamps, it is to be understood that the invention is not so limited. Rather, more or less than two C-clamps could be used to secure each generally L-shaped member 1, 2 to its respective creeper side.

Figure 3:
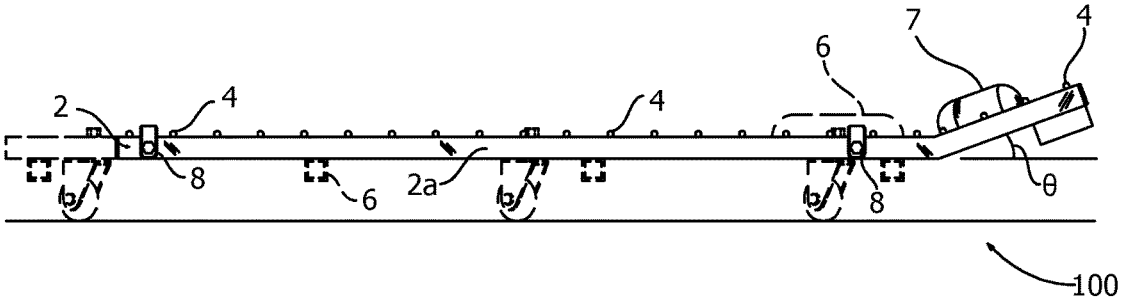
FIG. 3 is a right side view of the attachment device attached to an automotive creeper, according to an embodiment of the invention.

Now, referring to FIG. 3, the right generally L-shaped member 2 of the attachment device 100 is shown attached to an automotive creeper 6 with C-clamps 8. The illustrated embodiment of FIG. 3 also includes an additional headrest 7 (or head pad 7). Preferably, the head end of each side bar portion 1*a*, 2*a* of each generally L-shaped member 1, 2 is angled upward at an angle θ in the range of approximately 10 degrees to approximately 20 degrees, inclusive, or in range of 10 degrees to 20 degrees, inclusive (i.e., towards the head of a person lying on the creeper 6). In one embodiment, each generally L-shaped member 1, 2 is angled upward at an angle θ of approximately 20 degrees. Advantageously, this predetermined angle permits relaxed work periods without increased neck discomfort, and permits the light emitting devices 4 at the head end of the attachment device 100 (if provided therewith) to shine directly on the area or component of the vehicle that the mechanic is servicing. Also, the generally L-shaped members 1, 2 can be readily adjusted in a lengthwise direction of the creeper 6. In particular, the generally L-shaped members 1, 2 of the attachment device 100 can be slid forward or rearward relative to the creeper 6 (i.e., towards the head end or foot end of the creeper 6), and then, clamped in place using C-clamps 8. For example, sliding the generally L-shaped members 1, 2 of the attachment device 100 forward (i.e., towards the head end of the creeper 6) allows taller mechanics to use a creeper 6 which might otherwise be too short for them to work on comfortably. As such, a more custom fit for the mechanic can be readily obtained. The headrest 7 (or head pad 7) allows the mechanic to have head support, while reducing neck fatigue, when the generally L-shaped members 1, 2 are slid towards the head end of the creeper 6 and attached for accommodating a taller person. The headrest 7 of the attachment device 100 is particularly useful for conventional creepers that are not originally furnished with a headrest or head pad of any kind. While the C-clamps 8 may be used as one type of securement device for attaching the attachment device 100 to the creeper 6, it is to be understood that other types of securement devices may be used as well, such as hose clamps.

Figure 4:
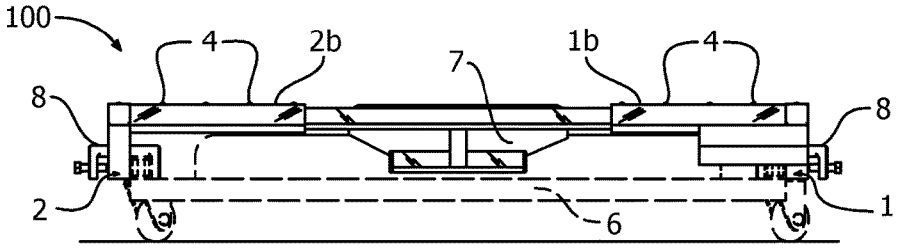
FIG. 4 is a head end view of the attachment device attached to an automotive creeper, according to an embodiment of the invention.

FIG. 4 illustrates a head end view of the attachment device 100 attached to an automotive creeper 6. Both generally L-shaped members 1, 2 are attached to each other at an adjustable joint 3 (see FIG. 2), and are each attached to the creeper 6 by means of C-clamps 8. The headrest 7 (or head pad 7) is coupled to the head portion 1*b*, 2*b* of each generally L-shaped member 1, 2. In the illustrated embodiment, a plurality of light emitting devices 4 (e.g., LED lamps) are spaced apart lengthwise along the top surface of each head portion 1*b*, 2*b* of each generally L-shaped member 1, 2. Although, in one or more alternative embodiments, some of the light emitting devices 4 (e.g., LED lamps) in the middle of the head end of the attachment device 100 may be replaced with a six (6) inch handheld, detachable light emitting device (e.g., a detachable LED light). Preferably, the detachable light emitting device will be fastened to the attachment device 100 with one or more clamps so that it can be removed and used when more light is needed in a certain area. Also, preferably, the light source will have constant power and will not need to be plugged into a building electrical receptacle (or electrical socket). As explained above, the light emitting devices 4 could be embodied in other forms as well, in addition to LED technology. Also, in one or more embodiments, the head end corner of each generally L-shaped member 1, 2 can have small speakers installed proximate thereto. As explained above with regard to FIG. 1, a small radio (e.g., a small AM/FM radio) could be used in conjunction with the attachment device 100. As another example of potential accessories for the attachment device 100, an iPod could be used with the device 100 if an iPod dock was added thereto. The aforementioned entertainment would be particularly beneficial if a mechanic is working underneath a vehicle for a long period of time. As previously explained, a mechanic could also play instructional recordings to assist him or her in performing a repair.

In one exemplary embodiment, the side bar portion 1*a*, 2*a* (side portion 1*a*, 2*a*) of each generally L-shaped member 1, 2 has a length of approximately forty (40) inches, while the head portion 1*b*, 2*b* of each generally L-shaped member 1, 2 has a length of between approximately eight (8) inches and approximately ten (10) inches. Although, one of ordinary skill in the art will appreciate that the invention is not so limited. Rather, other suitable lengths for the generally L-shaped members 1, 2 may be used without departing from the scope and spirit of the appended claims.

Figure 18:
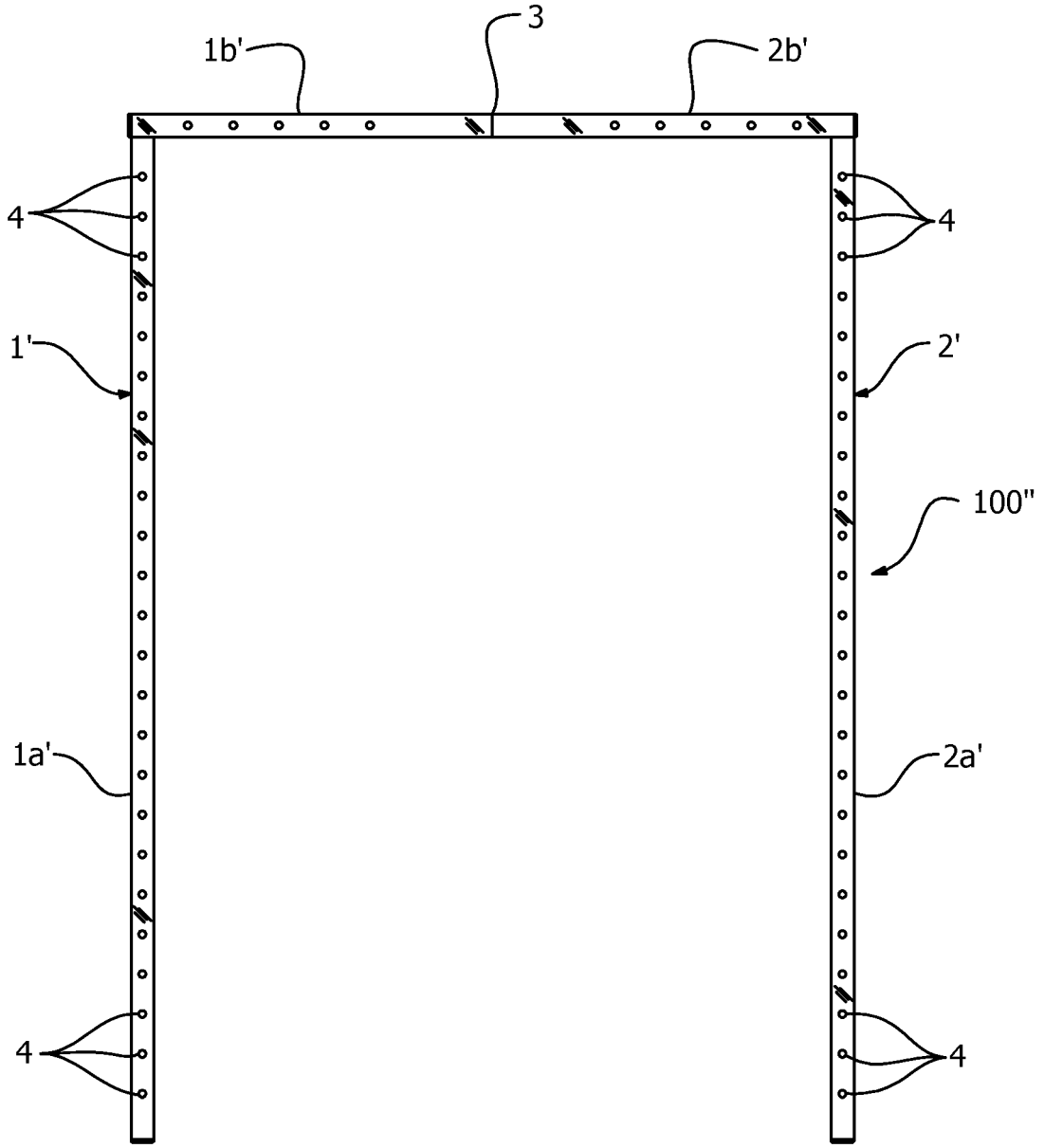
FIG. 18 is a perspective view of the two generally L-shaped members of the attachment device in an assembled state, according to an embodiment of the invention.
Figure 19:
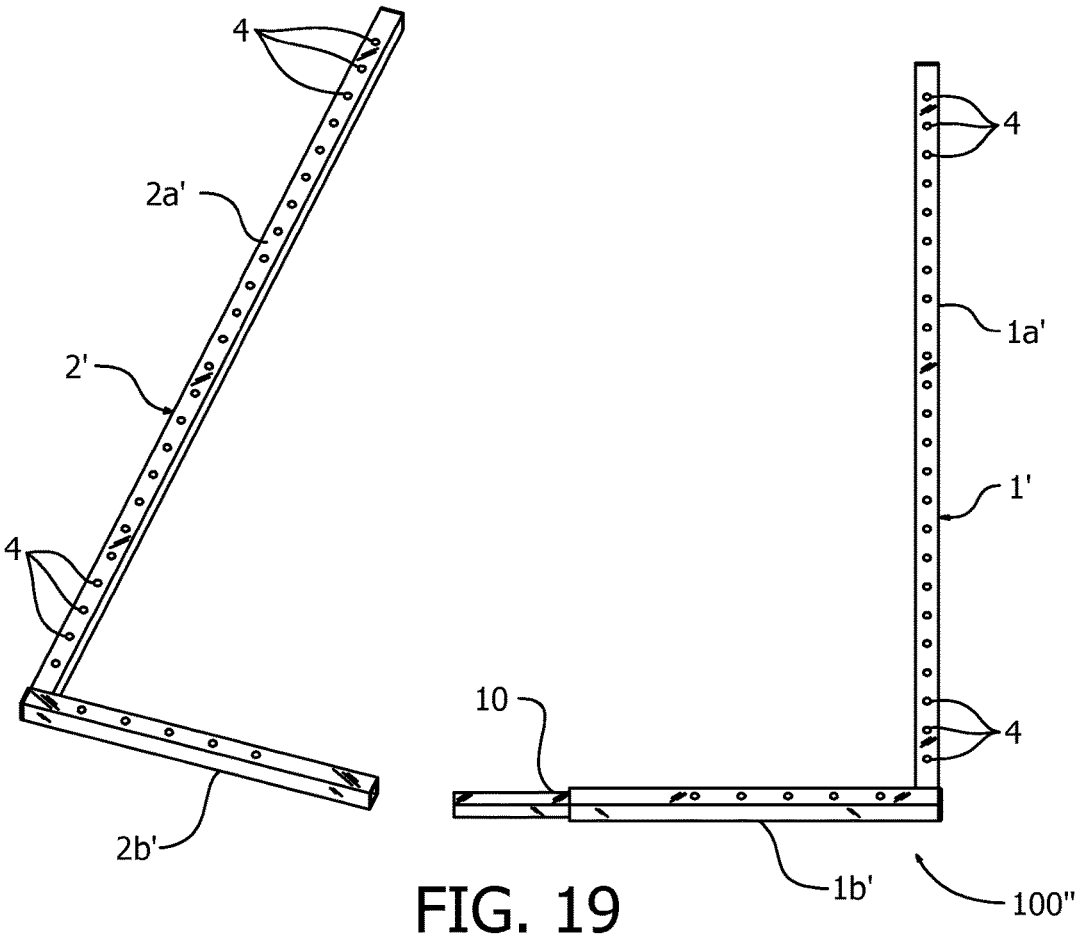
FIG. 19 is a perspective view of the two generally L-shaped members of the attachment device in an disassembled state, according to an embodiment of the invention.

FIG. 18 illustrates a modified version of the generally L-shaped members 1', 2' in an assembled state, whereas FIG. 19 illustrates the generally L-shaped members 1', 2' in a disassembled state so that one type of connecting member 10 (e.g., a generally straight tubular member of reduced cross-sectional area) is visible. Unlike the other embodiments of the attachment devices 100, 100', it can be seen that the side bar portions 1*a*', 2*a*' of the attachment device 100" of FIGS. 18 and 19 are generally straight without the head ends thereof being angled upwardly.

Figure 5:
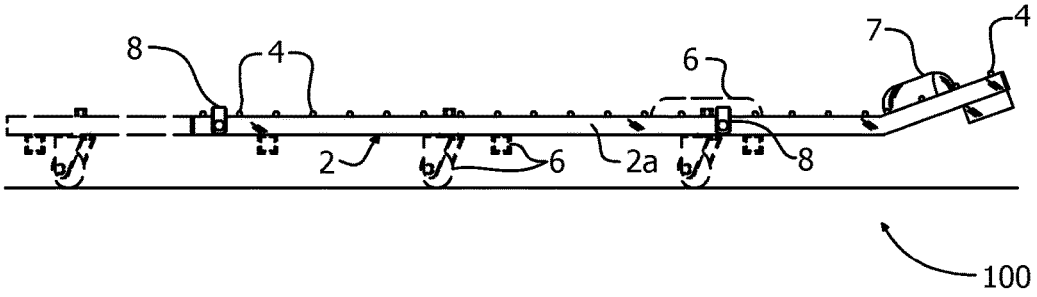
FIG. 5 is a right side view of the attachment device attached to an automotive creeper, according to an embodiment of the invention, wherein the attachment device is attached in an extended position so as to accommodate taller users of the creeper.

Referring now to FIG. 5, a right side view of the attachment device 100 attached to an automotive creeper 6 by means of C-clamps 8 is illustrated. This figure also depicts the additional headrest 7 (or head pad 7) of the attachment device 100. The head end of each side bar portion 1*a*, 2*a* of each generally L-shaped member 1, 2 is angled rearward (headward) at an angle of approximately 20 degrees. In FIG. 5, the attachment device 100 is installed further towards the head end of the automotive creeper 6. This enables taller mechanics to utilize a creeper 6 that may otherwise be too short for them to work on comfortably. Also, the headrest 7 (or head pad 7) allows the mechanic to have head support when the generally L-shaped members 1, 2 of the attachment device 100 are slid towards the head end of the creeper 6, and attached thereto for a taller person.

Figure 17:
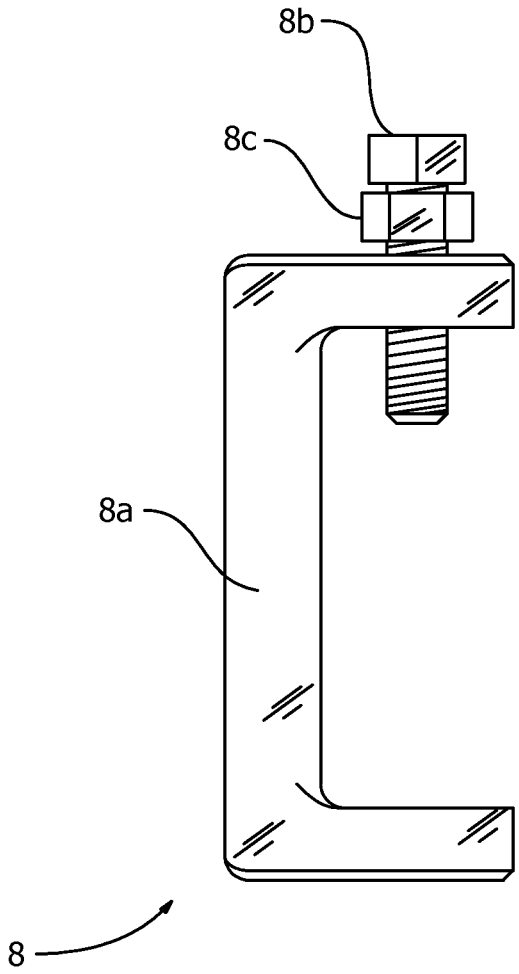
FIG. 17 is a frontal perspective view of a C-clamp, which is used for securing the attachment device to the automotive creeper and/or mechanics chair, according to an embodiment of the invention.

With reference to FIG. 17, an embodiment of a C-clamp 8 used in conjunction with the attachment device 100 is shown. It can be seen that the C-clamp 8 comprises a generally C-shaped body portion 8*a*, a bolt 8*b* threadingly received within an aperture of the generally C-shaped body portion 8*a*, and a nut 8*c* threadingly coupled to the bolt 8*b*. One or more C-clamps 8 are used to secure the attachment device 100 to an automotive creeper 6 and/or the mechanics chair described hereinafter.

Figure 8:
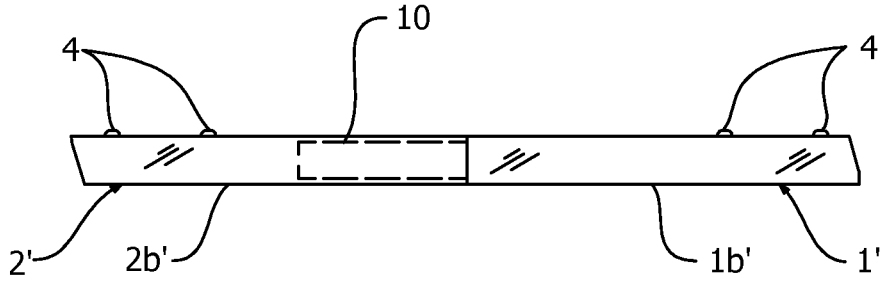
FIG. 8 is an enlarged view illustrating a first coupling means for the two generally L-shaped members which form the attachment device, according to an embodiment of the invention.

An enlarged view illustrating a first coupling means (connecting member) for the two generally L-shaped members 1', 2' of the attachment device 100" is illustrated in FIG. 8. In particular, the end of the head portion 1*b*' of the first generally L-shaped member 1' is provided with the generally straight tubular member 10, which has a smaller cross-section area, affixed thereto (also see FIG. 19). In one exemplary embodiment, the generally L-shaped members 1', 2' each have a cross-sectional area of approximately one (1) inch by one (1) inch, whereas the tubular member 10 has a cross-sectional area of approximately three-quarters (¾) of an inch by three-quarters (¾) of an inch. In a preferred embodiment, the smaller tubular member 10 is welded to the end of the head portion 1*b*' of the first generally L-shaped member 1'. As shown in FIG. 8, the smaller tubular member 10 is slidably received within the head portion 2*b*' of the second generally L-shaped member 2'. Because the end of the first generally L-shaped member 1' is capable of sliding back-and-forth within the end portion of the second generally L-shaped member 2', the attachment device 100" is capable of being adjusted so as to accommodate automotive creepers 6 having variable widths.

Figure 10:
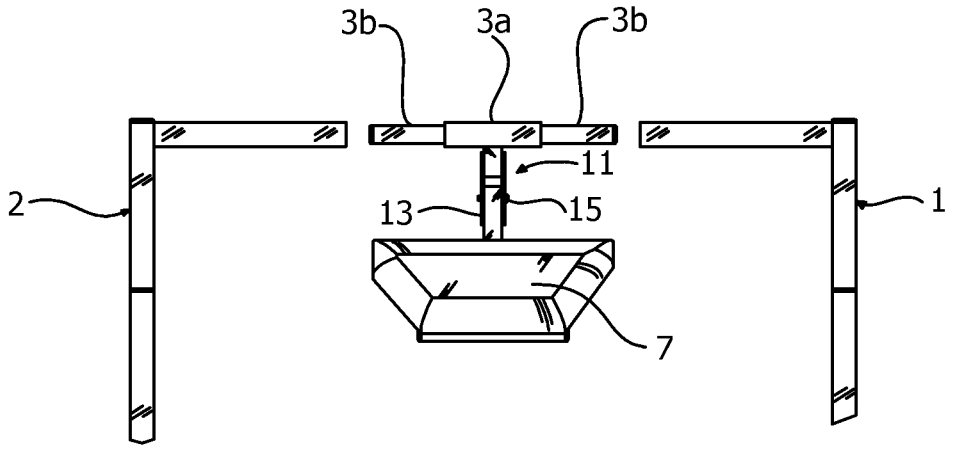
FIG. 10 is an enlarged view illustrating a second coupling means for the two generally L-shaped members which form the attachment device, according to an embodiment of the invention.

Referring now to FIG. 10, an enlarged view of a second coupling means (connecting member) for the two generally L-shaped members 1, 2 is shown. The second coupling means for the two generally L-shaped members 1, 2 comprises a generally T-shaped member with opposed end portions 3*b* having reduced cross-sectional areas so as to enable the end portions 3*b* to be inserted into the ends of the generally L-shaped members 1, 2. As shown in FIG. 10, the generally T-shaped member is part of a T-bar system 3*a*, which includes mounting means for the headrest 7 (or head pad 7). In this embodiment, the headrest 7 can also be adjusted further up and down with the movable connection 11 (pivotable connection 11), and then locked in place with a pin 15. In one exemplary embodiment, a majority of the generally T-shaped member has a cross-sectional area of approximately one (1) inch by one (1) inch, except for the opposed end portions 3*b* of reduced cross-sectional area, which have a cross-sectional area of approximately three-quarters (¾) of an inch by three-quarters (¾) of an inch.

Figure 15:
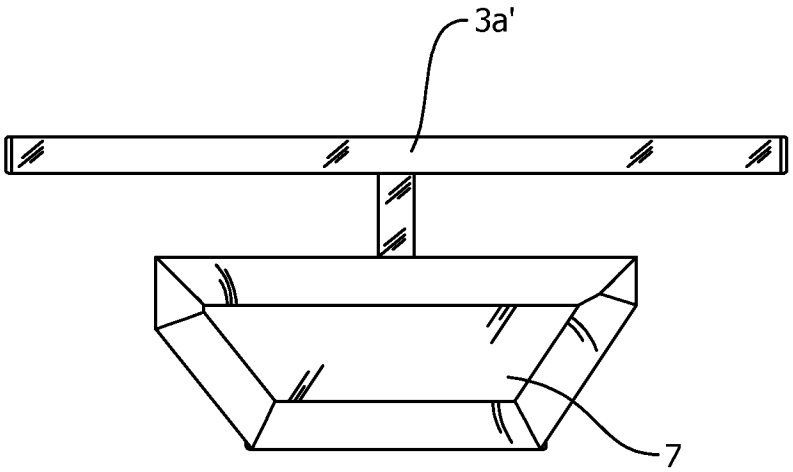
FIG. 15 is an enlarged front view illustrating a modified second coupling means for the two generally L-shaped members, according to an embodiment of the invention.
Figure 16:
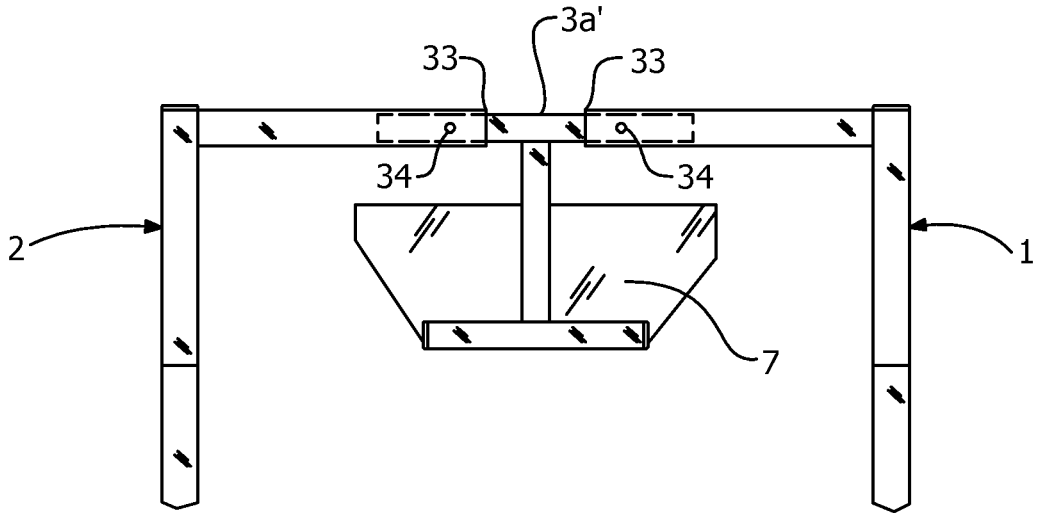
FIG. 16 is an enlarged rear view illustrating the modified second coupling means for the two generally L-shaped members, according to an embodiment of the invention, wherein the alternative second coupling means is shown connecting the two generally L-shaped members together.

A modified version of the second coupling means (connecting member) for the two generally L-shaped members 1, 2 is depicted in FIGS. 15 and 16. In most respects, the modified T-bar system 3*a*' of FIGS. 15 and 16 is generally the same as the T-bar system 3*a* of FIG. 10. However, unlike the T-bar system 3*a*, the modified T-bar system 3*a*' does not have opposed end portions 3*b* with reduced cross-sectional areas. Rather as shown in FIGS. 15 and 16, the generally T-shaped member has a substantially uniform cross-sectional area throughout. In one exemplary embodiment, the generally T-shaped member of FIGS. 15 and 16 has a cross-sectional area of approximately three-quarters (¾) of an inch by three-quarters (¾) of an inch throughout so that it is capable of being inserted into the open ends of the generally L-shaped members 1, 2, which can have a cross-sectional area of approximately one (1) inch by one (1) inch.

As shown in FIGS. 15 and 16, the headrest 7 (or head pad 7) is supported by the T-bar system 3*a*'. In particular, the headrest 7 is attached to the base of the generally T-shaped member of the T-bar system 3*a*'. Referring to FIG. 16, it can be seen that the opposed ends of the generally T-shaped member are inserted into the open ends 33 of each generally L-shaped member 1, 2. The position of each generally L-shaped member 1, 2 can be slidably adjusted relative to the generally T-shaped member so as to permit the attachment device 100 to accommodate automotive creepers of various widths. Once each generally L-shaped member 1, 2 has been adjusted to its desired position, it can be secured in place by tightening the fasteners 34 (e.g., bolts) against the outer surface of the generally T-shaped member. In one exemplary embodiment, the inner width of the attachment device 100 (i.e., the distance between the inner side of each side bar portion 1*a*, 2*a*) is adjustable in the range between approximately seventeen (17) inches and approximately twenty-four (24) inches (or between 17 and 24 inches). Advantageously, this enables the attachment device 100 to be used with a vast majority of the automotive creepers on the market today.

Figure 11:
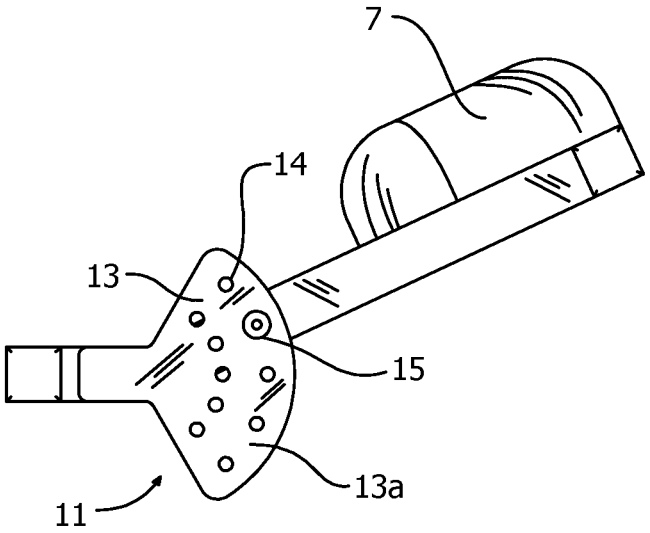
FIG. 11 is an enlarged view illustrating an optional hinge joint for adjusting the angle of the headrest portion of the attachment device, according to an embodiment of the invention.

In FIG. 11, an enlarged view of an optional hinge joint for adjusting the angle of the headrest portion 7 of the attachment device 100 is depicted. In particular, the adjustable hinge 13 allows the headrest 7 (or head pad 7) to be adjusted further up and down while attached to both generally L-shaped members 1, 2. As shown in FIG. 11, the adjustable hinge 13 comprises a semi-circular end portion 13*a* with a plurality of spaced apart apertures 14 disposed therein. A pin or detent 15 engages with one of the spaced apart apertures 14 in the semi-circular end portion 13*a* in order to lock the angular position of the headrest 7.

Figure 12:
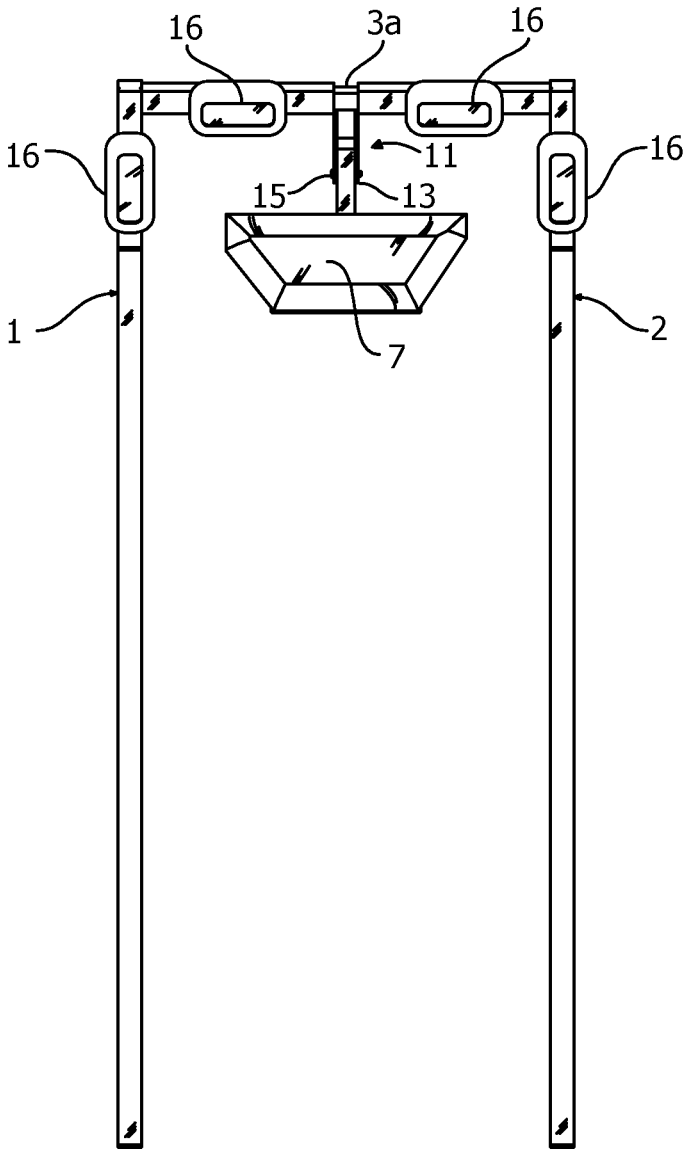
FIG. 12 is a frontal view of the attachment device illustrating one variation of the headrest portion and removable light emitting devices, according to an embodiment of the invention.

Now, with reference to FIG. 12, a frontal (top) view of the generally L-shaped members 1, 2 coupled together by means of the T-bar system 3*a* is illustrated. As explained above with regard to FIG. 10, the adjustment joint 11 enables the angular position of the headrest 7 to be selectively adjusted. In FIG. 12, it can also be seen that each of the generally L-shaped members 1, 2 are provided with a plurality of removable light emitting devices 16 near the headrest 7 (e.g., each generally L-shaped member 1, 2 is provided with two (2) removable light emitting devices 16 disposed on the top surface thereof). In a preferred embodiment, the removable light emitting devices 16 comprise removable, magnetically-attached LED lights that can be selectively positioned on each of the generally L-shaped members 1, 2. Preferably, each of the generally L-shaped members 1, 2 is formed from a metallic material (e.g., a lightweight, but strong steel), so that the magnet(s) on the back of each LED light is readily attracted to the outer surfaces of the members 1, 2.

Figure 20:
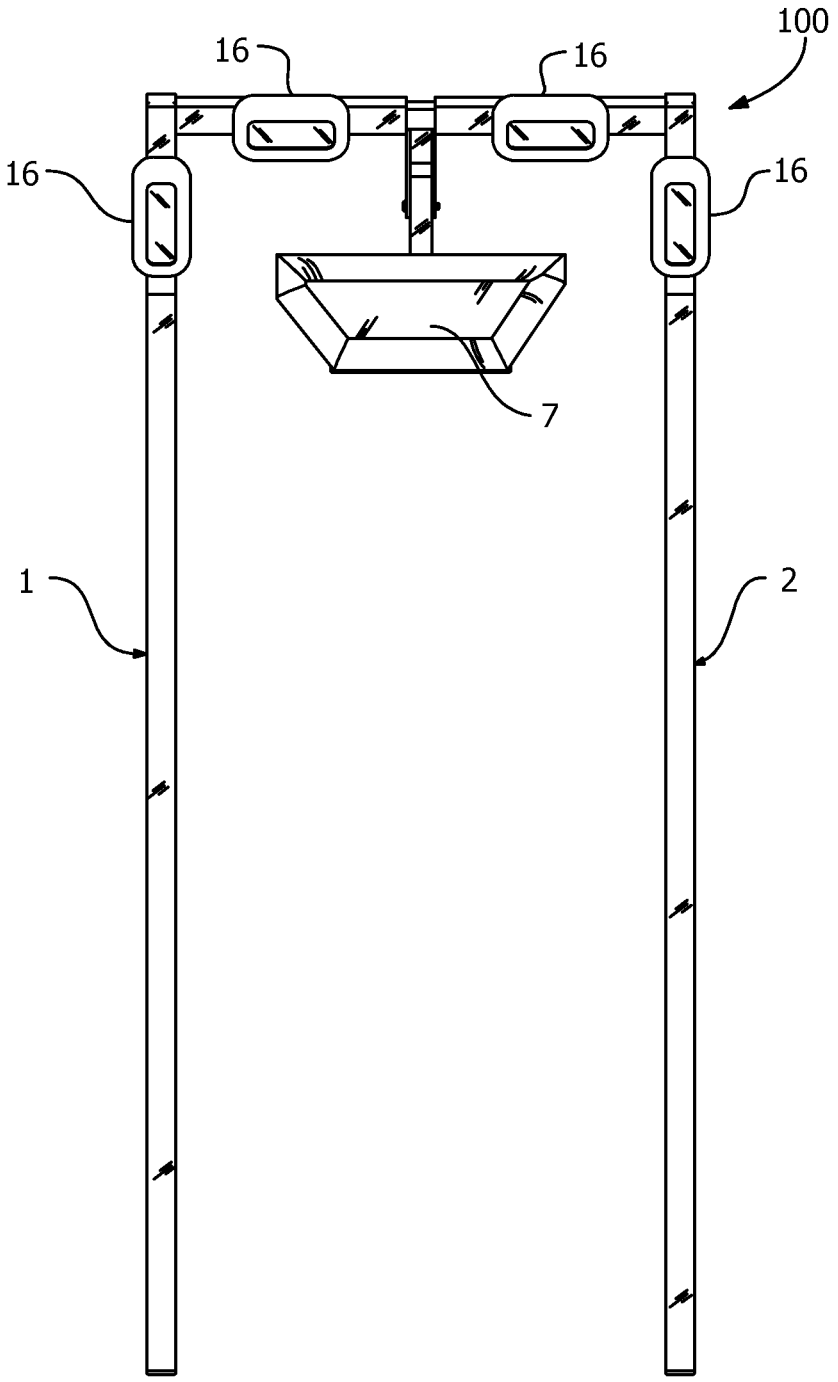
FIG. 20 is a top plan view of the attachment device, according to an embodiment of the invention, wherein the attachment device includes a headrest and a plurality of removable light emitting devices.
Figure 21:
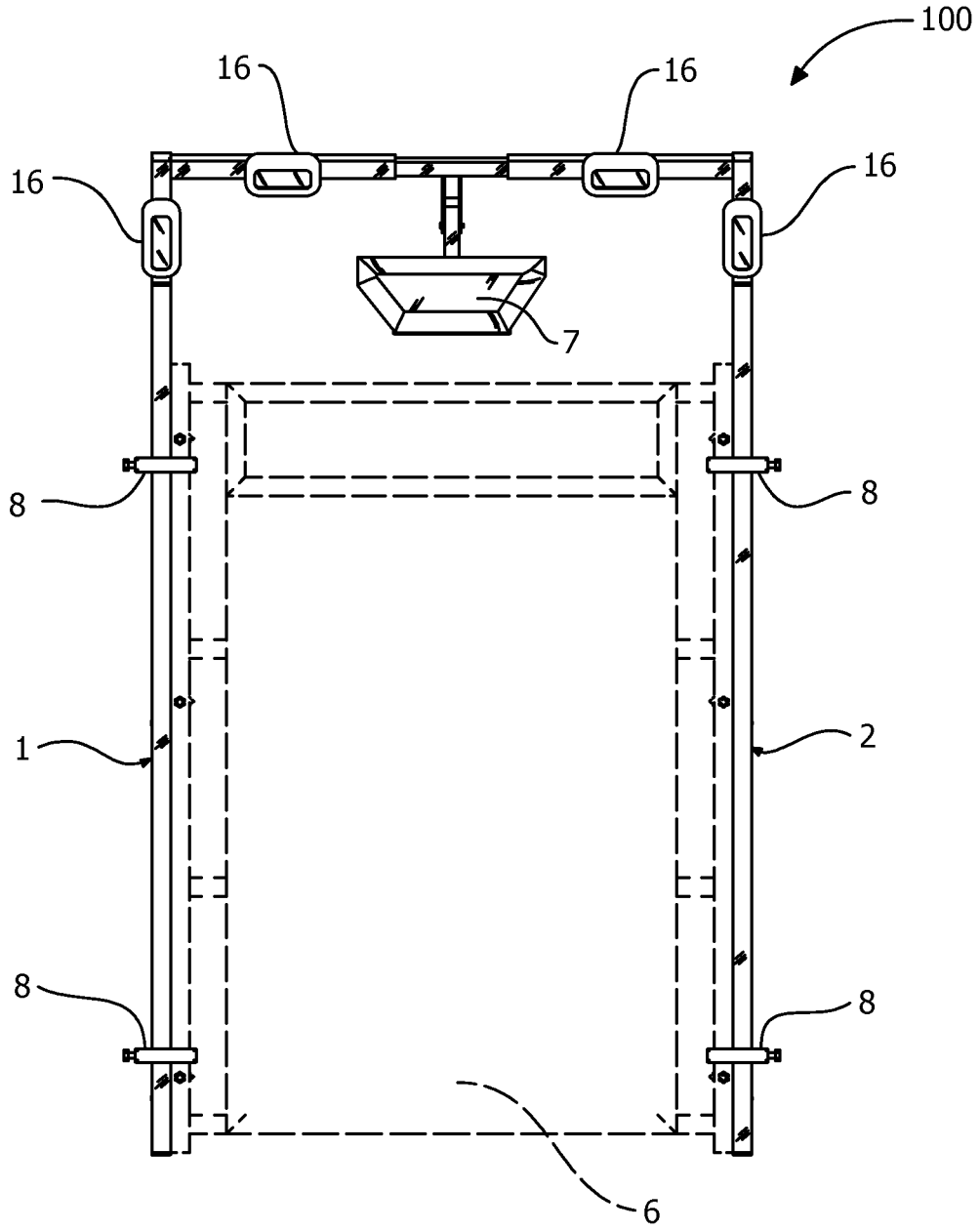
FIG. 21 is one top plan view of the attachment device attached to an automotive creeper, according to an embodiment of the invention, wherein the attachment device includes a headrest and a plurality of removable light emitting devices.
Figure 22:
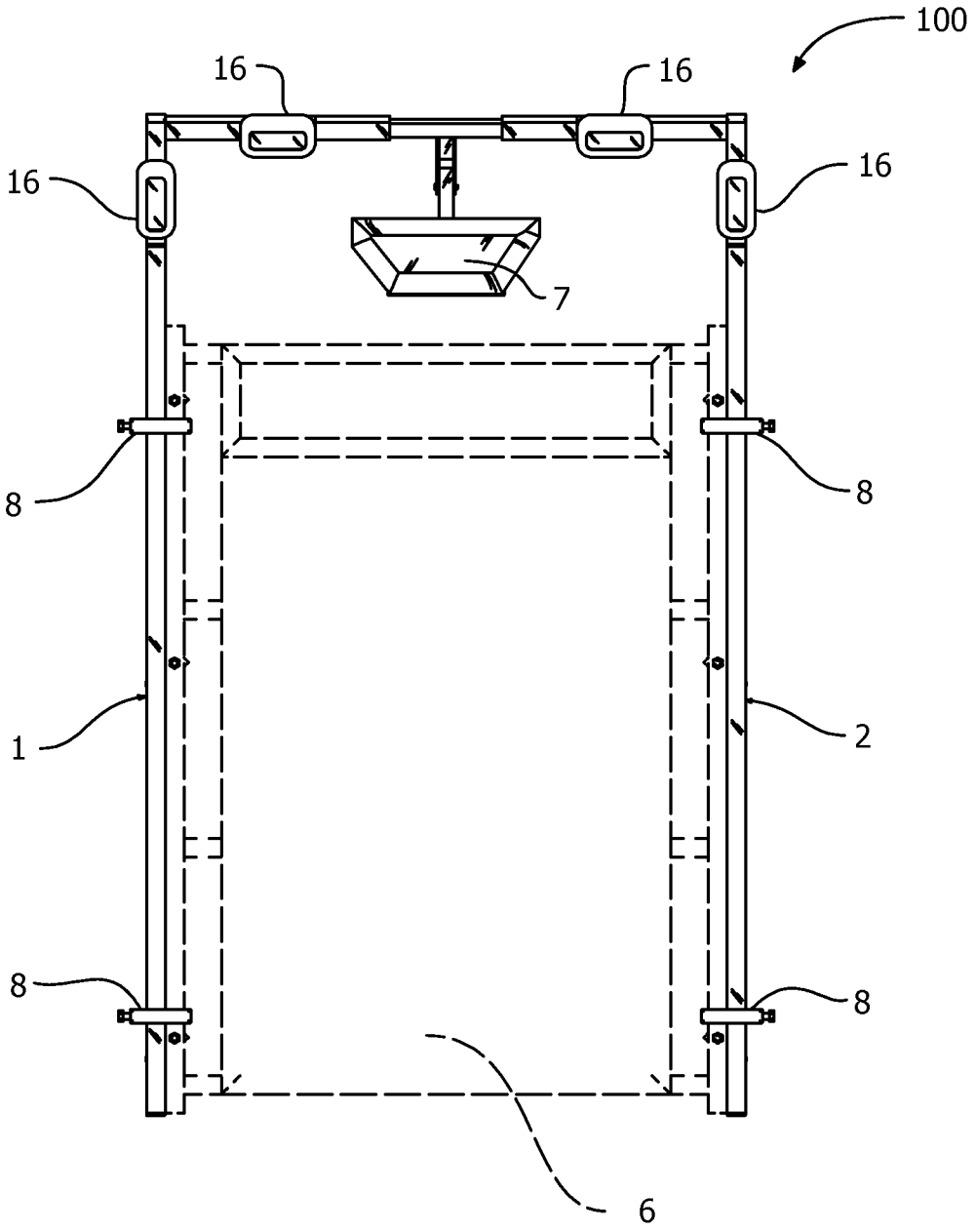
FIG. 22 is another top plan view of the attachment device attached to an automotive creeper, according to an embodiment of the invention, wherein the attachment device includes a headrest and a plurality of removable light emitting devices.
Figure 23:
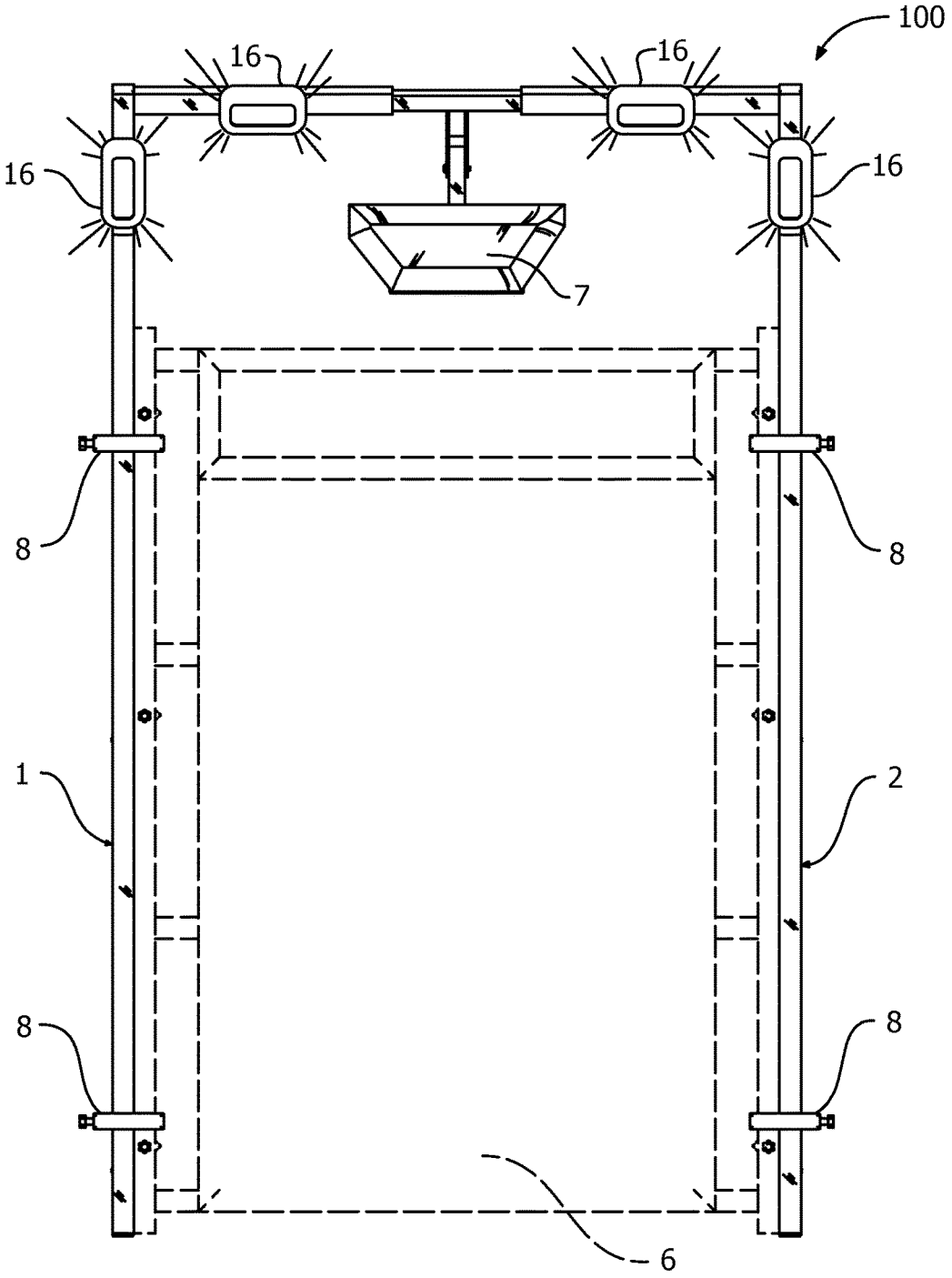
FIG. 23 is yet another top plan view of the attachment device attached to an automotive creeper, according to an embodiment of the invention, wherein the attachment device includes a headrest and a plurality of removable light emitting devices that are turned "on"

The attachment device 100 of FIG. 20 is shown attached to an automotive creeper 6 in FIGS. 21-23 by means of C-clamps 8. In FIG. 23, the removable light emitting devices 16 are turned "on" in order to generally illustrate the functionality of these lights 16. These light emitting devices 16 can produce enough light to sufficiently illuminate the undercarriage of vehicle while it is being serviced.

Figure 13:
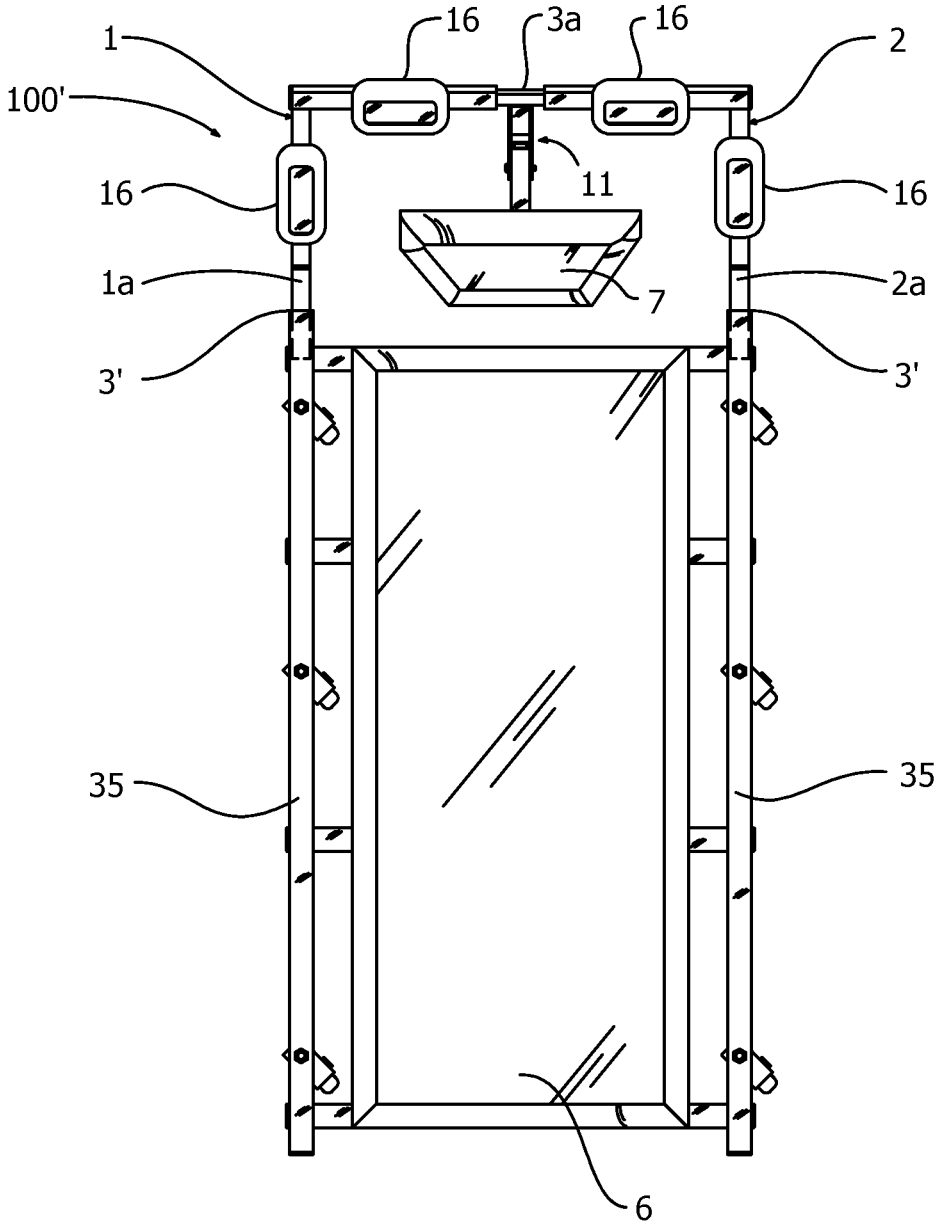
FIG. 13 is a top view of an alternative attachment device attached to an automotive creeper, according to an embodiment of the invention.
Figure 14:
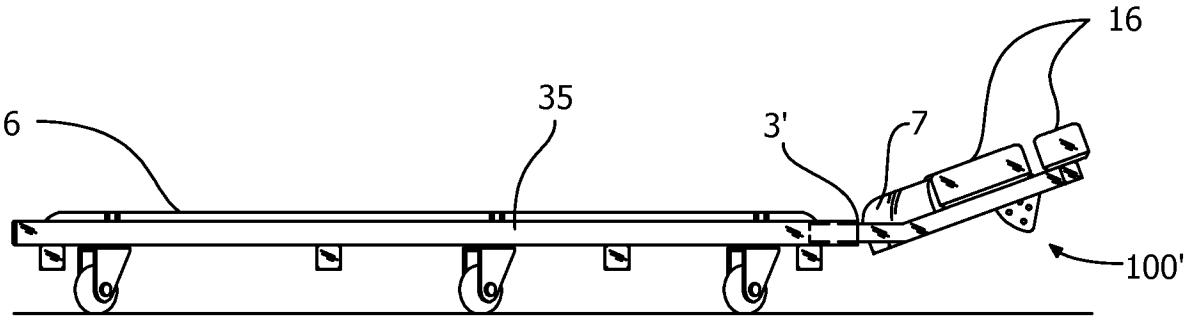
FIG. 14 is a right side view of the alternative attachment device attached to an automotive creeper, according to an embodiment of the invention.

Another embodiment of the attachment device is shown in FIGS. 13 and 14. The attachment device 100' of FIGS. 13 and 14 attaches to the automotive creeper 6 in a different manner than that which was previously described for the attachment device 100. In particular, rather than attaching the generally L-shaped members 1, 2 to the automotive creeper 6 using C-clamps 8, the end of each side bar portion 1*a*, 2*a* of each generally L-shaped member 1, 2 slips into a respective side tubular member 35 of the automotive creeper 6 (see e.g., FIG. 14). As such, there is an adjustable side joint 3' on each side of the creeper 6. The length of each side bar portion 1*a*, 2*a* of each generally L-shaped member 1, 2 protruding from the head end of the automotive creeper 6 can be selectively adjusted by a user, and then secured in place by using suitable securement means (e.g., respective fasteners engaging the outer surfaces of the side bar portions 1*a*, 2*a*). Similar to the previously described embodiments of the attachment device 100, the attachment device 100' includes a T-bar system 3*a* with a headrest 7 adjustably mounted thereto (refer to FIG. 13). The angle at which the headrest is disposed can be adjusted by means of the adjustment joint 11. Also, similar to the aforedescribed embodiments of the attachment device 100, the generally L-shaped members 1, 2 are each provided with a plurality of removable light emitting devices 16 disposed thereon.

In some embodiments, the attachment device 100 is in the form of an add-on, self-contained, rechargeable lighting system, which fits most of the automotive creepers on the market today. The attachment device 100 could also fit future creeper models. In particular, the attachment device 100 is an add-on item for people who already own a creeper. Therefore, the person does not have to replace his or her current creeper. If the person's creeper needs replaced, this unit can be easily removed and attached to the replacement creeper. The attachment device 100 can also be added to new creepers and sold as a complete unit.

It is readily apparent that the aforedescribed attachment device 100, 100', 100" offers numerous advantages. For example, the attachment device 100, 100', 100" is very easy to attach to an automotive creeper and can be done so in less than 5 minutes. Also, the attachment device 100, 100', 100" can be secured to an automotive creeper without drilling any holes into the creeper components, thereby maintaining the structural integrity of the creeper. The attachment device 100, 100', 100" described herein is relatively slender and unobtrusive so as not inhibit the ability of the creeper to be moved around in tight areas. The attachment device 100, 100', 100" allows the work on vehicles to be performed in a safer and easier manner by providing hands-free light and/or better head support for the mechanic. As a result, accidents and time lost from work could be substantially reduced due to fewer injuries during vehicle repair. In addition, the useful life of existing equipment could be extended by obviating the need to replacement existing creepers that are in good working condition.

Figure 6:
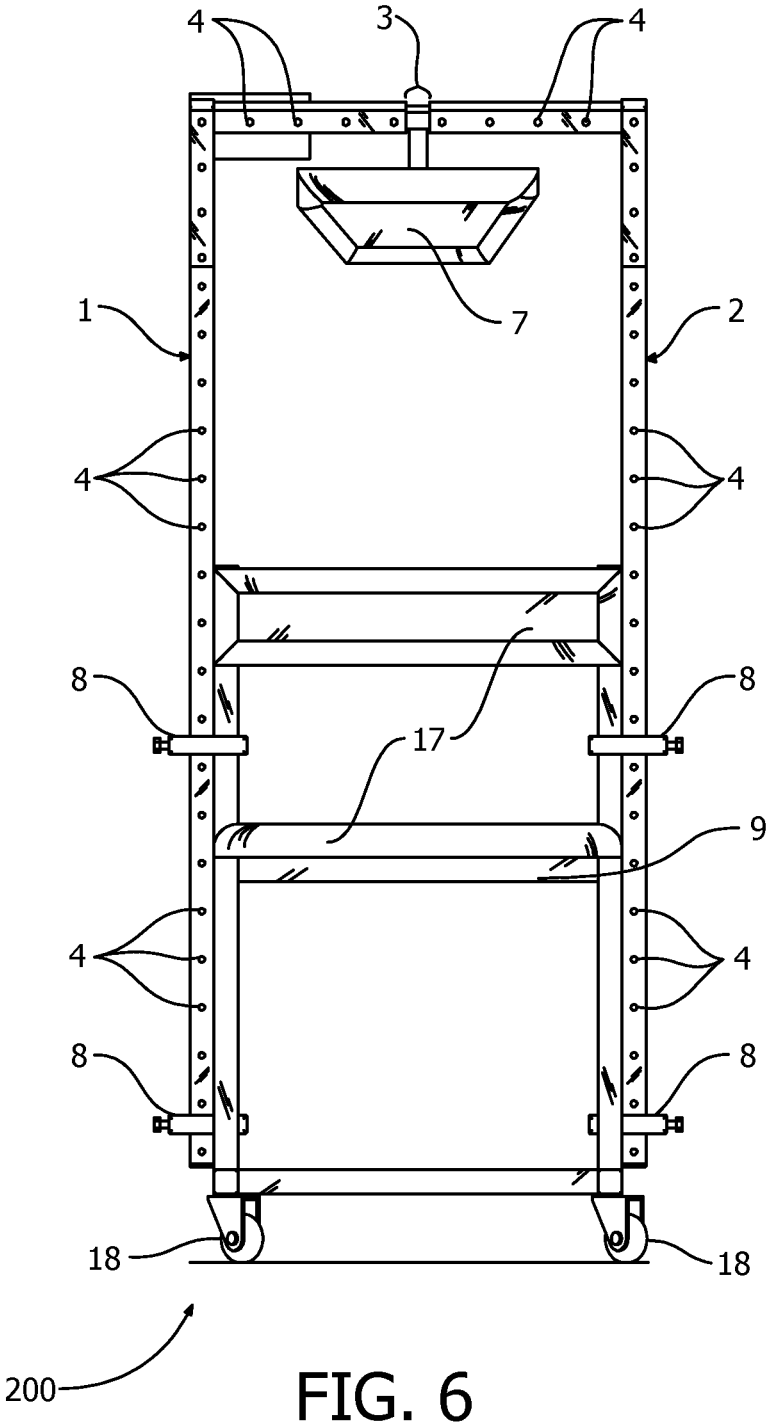
FIG. 6 is a frontal view of a mechanics chair with the attachment device attached thereto, according to an embodiment of the invention, wherein the attachment device is in a first position.

Now, with reference to FIGS. 6, 7, 9, and 24-26, the mechanics chair assembly 200 will be described in detail. In FIG. 6, a front view of the mechanics chair assembly 200 is shown with the generally L-shaped members 1, 2 attached to the mechanics chair 9. As illustrated in this figure, a plurality of light emitting devices 4 are spaced apart along substantially the entire length of each generally L-shaped member 1, 2. Also, the headrest 7 (or head pad 7) is shown attached to the generally L-shaped members 1, 2 in FIG. 6. In addition, in FIG. 6, it can be seen that the mechanics chair is preferably provided with one or more pads 17 (e.g., vinyl pads) so as to facilitate the comfort of the individual sitting thereon. The mechanics chair 9 is also preferably provided with a plurality of wheels 18 pivotally mounted thereto in order to enhance the portability of the mechanics chair.

Figure 7:
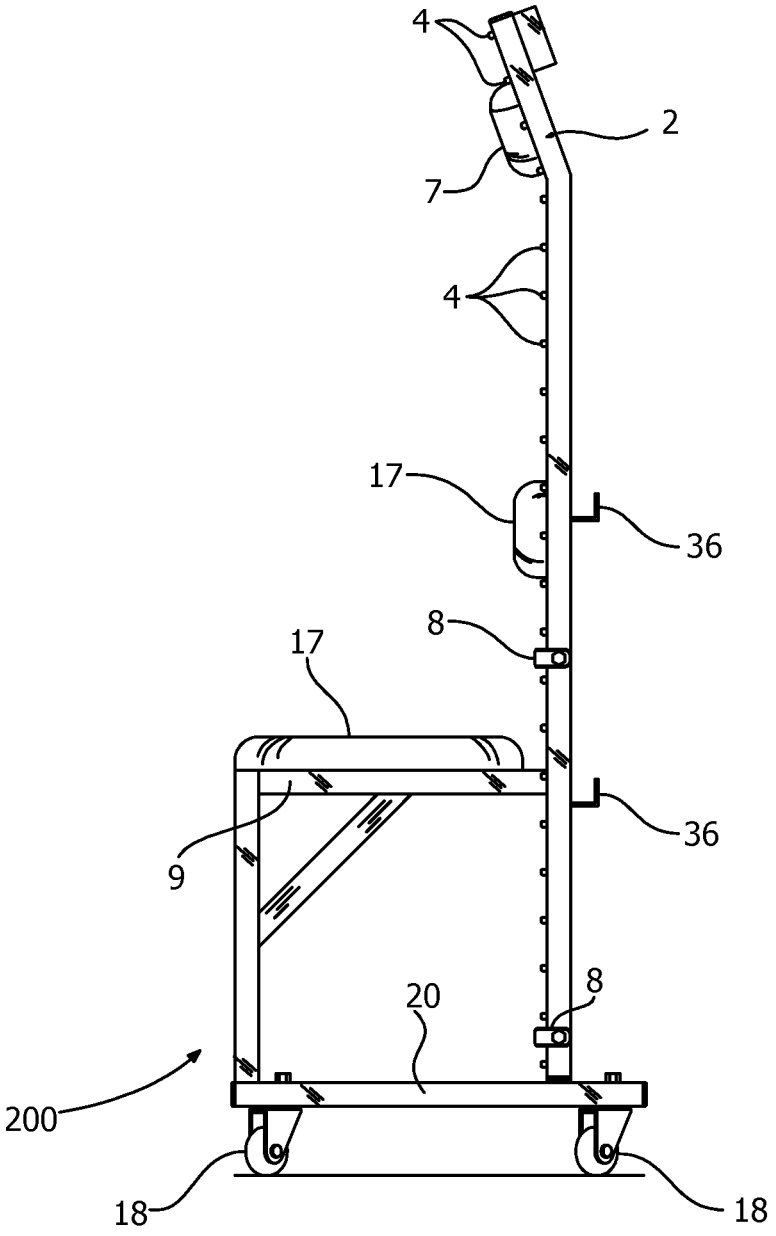
FIG. 7 is a left side view of the mechanics chair with the attachment device attached thereto, according to an embodiment of the invention.

In the side view of FIG. 7, it can be seen that the generally L-shaped members 1, 2 are attached to the mechanics chair 9 using the same C-clamps 8 described above with regard to the attachment device 100. Advantageously, the attachment device 100 can be used interchangeably with the automotive creeper 6 and the mechanics chair 9. Thus, there is not a need to purchase two separate attachment devices 100. Rather, the attachment device 100 can be simply transferred from the automotive creeper 6 to the mechanics chair 9, and vice versa, as required.

Figure 9:
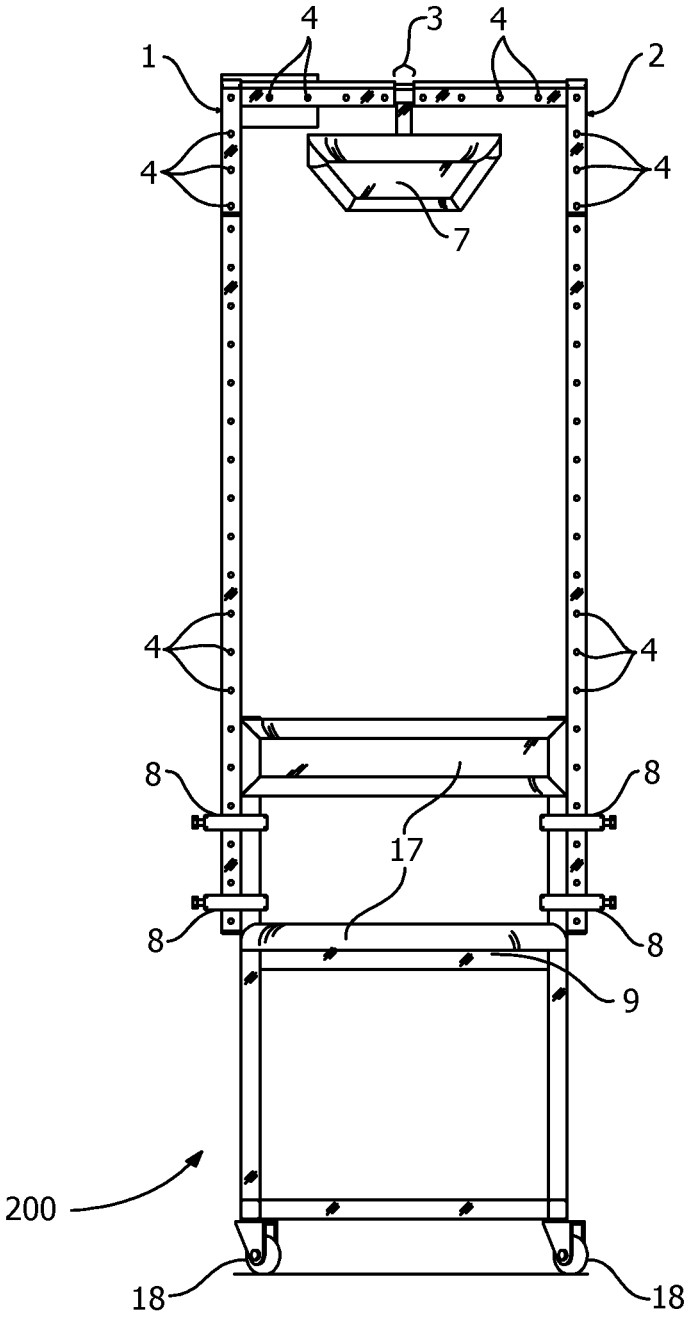
FIG. 9 is a frontal view of the mechanics chair with the attachment device attached thereto, according to an embodiment of the invention, wherein the attachment device is in a second raised position.

In FIG. 9, another front view of the mechanics chair assembly 200 is shown with the generally L-shaped members 1, 2 attached to the mechanics chair 9. In this view, it can be seen that the generally L-shaped members 1, 2 are preferably attached to the structure of the mechanics chair 9 using a plurality of C-clamps 8 on opposite sides thereof. While two (2) C-clamps 8 are used on each side of the mechanics chair 9 in the illustrated embodiment, it is to be understood that the invention is not so limited. Rather, more or less than two C-clamps could be used to secure each generally L-shaped members 1, 2 to its respective side of the mechanics chair 9.

Next, the structural frame of the mechanics chair 9 will be explained in detail with reference to FIG. 24. As shown in this figure, the base of the frame of the mechanics chair assembly 200 is generally rectangular in shape, and includes a first base side member 19 and a second base side member 20, which is spaced apart from the first base side member 19 by the length of the transverse base members 21. The first and second base side members 19, 20 are disposed generally parallel to one another, while the transverse base members 21 are disposed generally perpendicular to each of the first and second base side members 19, 20. As best illustrated in the side view of FIG. 7, it can be seen that the first and second base side members 19, 20 extend beyond the seat frame structure disposed thereabove in order to enhance the stability of the mechanics chair assembly 200. Referring again to FIG. 24, the seat structure of the mechanics chair 9 comprises first and second seat side members 22, 23, which are spaced apart from one another by the length of two transverse seat members 24, 25. The first and second seat side members 22, 23 are disposed generally parallel to one another, while each of the two transverse seat members 24, 25 are disposed generally perpendicular to each of the two seat side members 22, 23. The first transverse seat member 24 is disposed in the front of the seat, while the second transverse seat member 25 is disposed near the rear of the seat. In order to increase the chair strength when the weight of an individual is applied to the seat of the mechanics chair 9, each side of the mechanics chair 9 is provided with a diagonal reinforcing member 26, 27. The diagonal reinforcing member 26 connects first seat side member 22 to a first vertical support member 28, which connects the base structure of the mechanics chair 9 to the seat structure. Similarly, the diagonal reinforcing member 27 connects second seat side member 23 to a second vertical support member 29. The first and second vertical support members 28, 29 are disposed generally parallel to one another, and each is disposed generally perpendicular to the first and second base side members 19, 20 and first and second seat side members 22, 23.

In one embodiment, the diagonal reinforcing members 26, 27 form an approximately forty-five (45) degree angle with their respective seat side members 22, 23 and their respective vertical supports members 28, 29.

Figure 24:
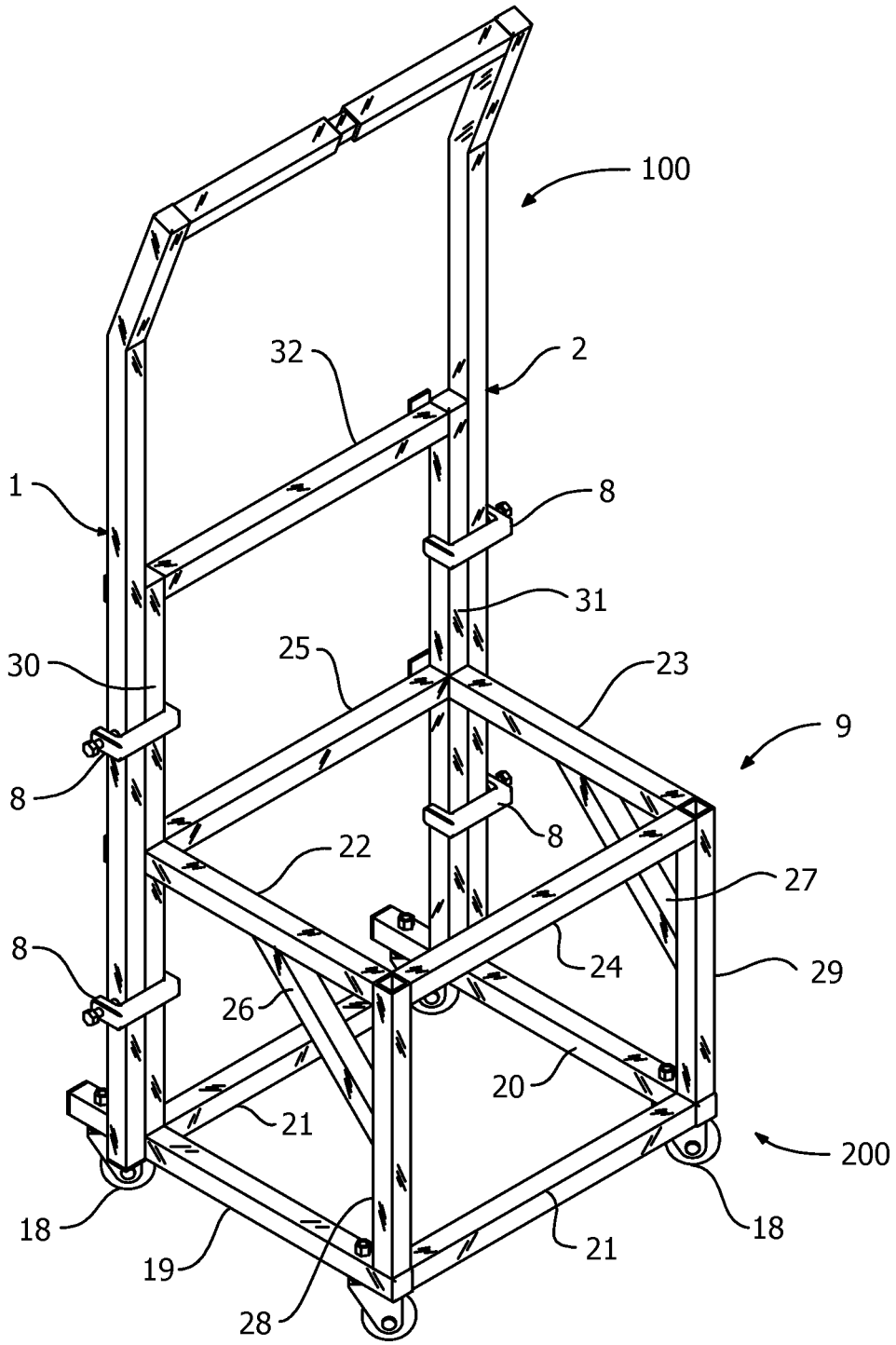
FIG. 24 is a perspective view of the structural frame of the mechanics chair with the two generally L-shaped members of the attachment device attached thereto, according to an embodiment of the invention.

As shown in FIG. 24, the seat back frame structure of the mechanics chair 9 comprises a first vertical frame member 30 and a second vertical frame member 31, which is spaced apart from the first vertical frame member 30 by the length of a transverse seat back member 32. The first and second vertical frame members 30, 31 are disposed generally parallel to one another, and each is disposed generally perpendicular to the first and second seat side members 22, 23 and transverse seat back member 32. In FIG. 24, it can be seen that the attachment assembly 100 is secured to the seat back frame structure of the mechanics chair 9 by means of C-clamps 8. In particular, the first generally L-shaped member 1 is attached to the first vertical frame member 30 of the mechanics chair 9 by two (2) C-clamps 8, while the second generally L-shaped member 2 is attached to the second vertical frame member 31 of the mechanics chair 9 by an additional two (2) C-clamps 8. Advantageously, the attachment assembly 100 provides an elongated backrest, as well as headrest, for a user of the mechanics chair 9. As such, the use of the attachment assembly 100 in conjunction with the mechanics chair 9 enhances comfort, and reduces fatigue, while an individual is servicing a vehicle.

Figure 25:
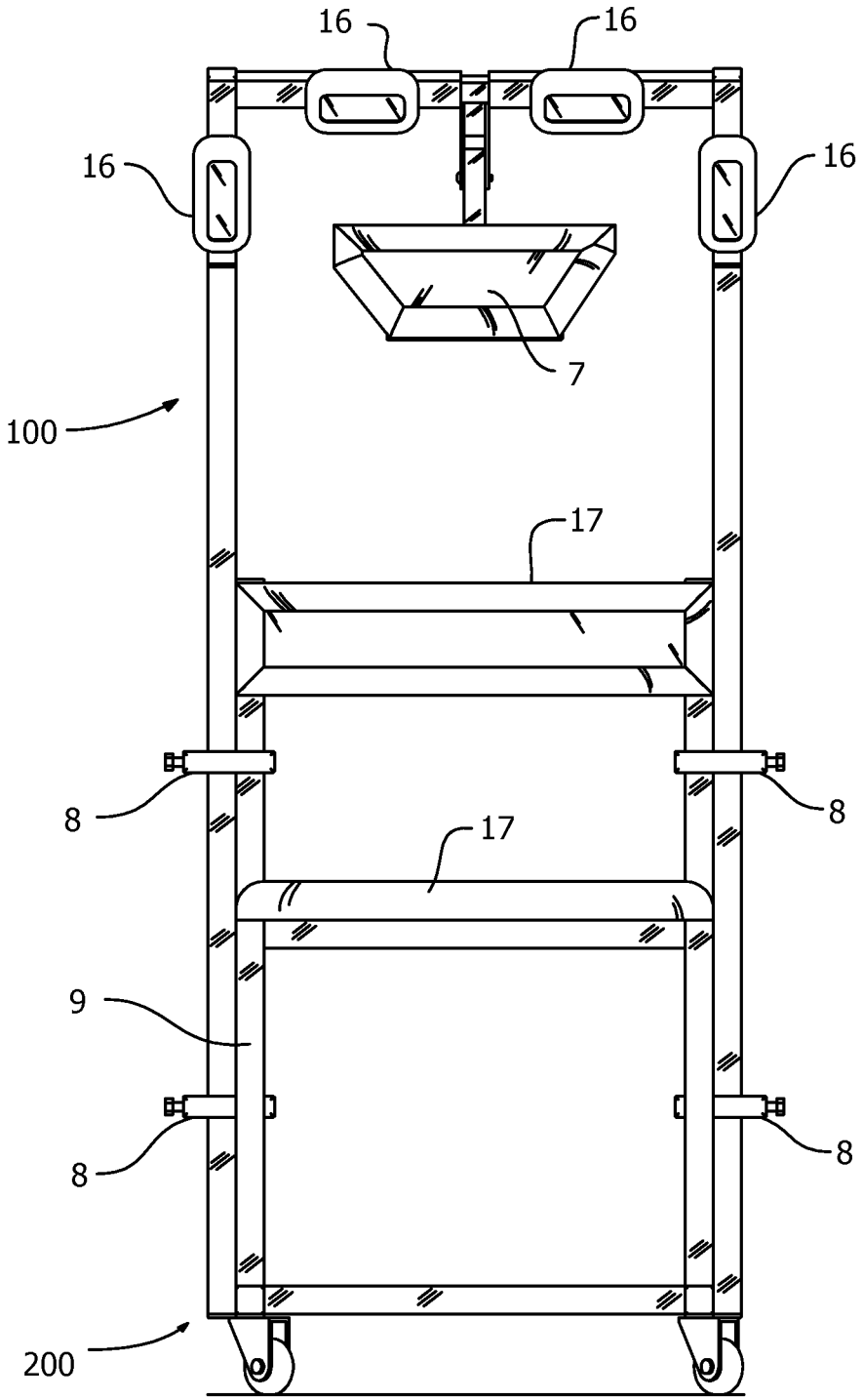
FIG. 25 is a frontal perspective view of a mechanics chair with the attachment device attached thereto, according to an embodiment of the invention, wherein the attachment device includes a headrest and a plurality of removable light emitting devices.
Figure 26:
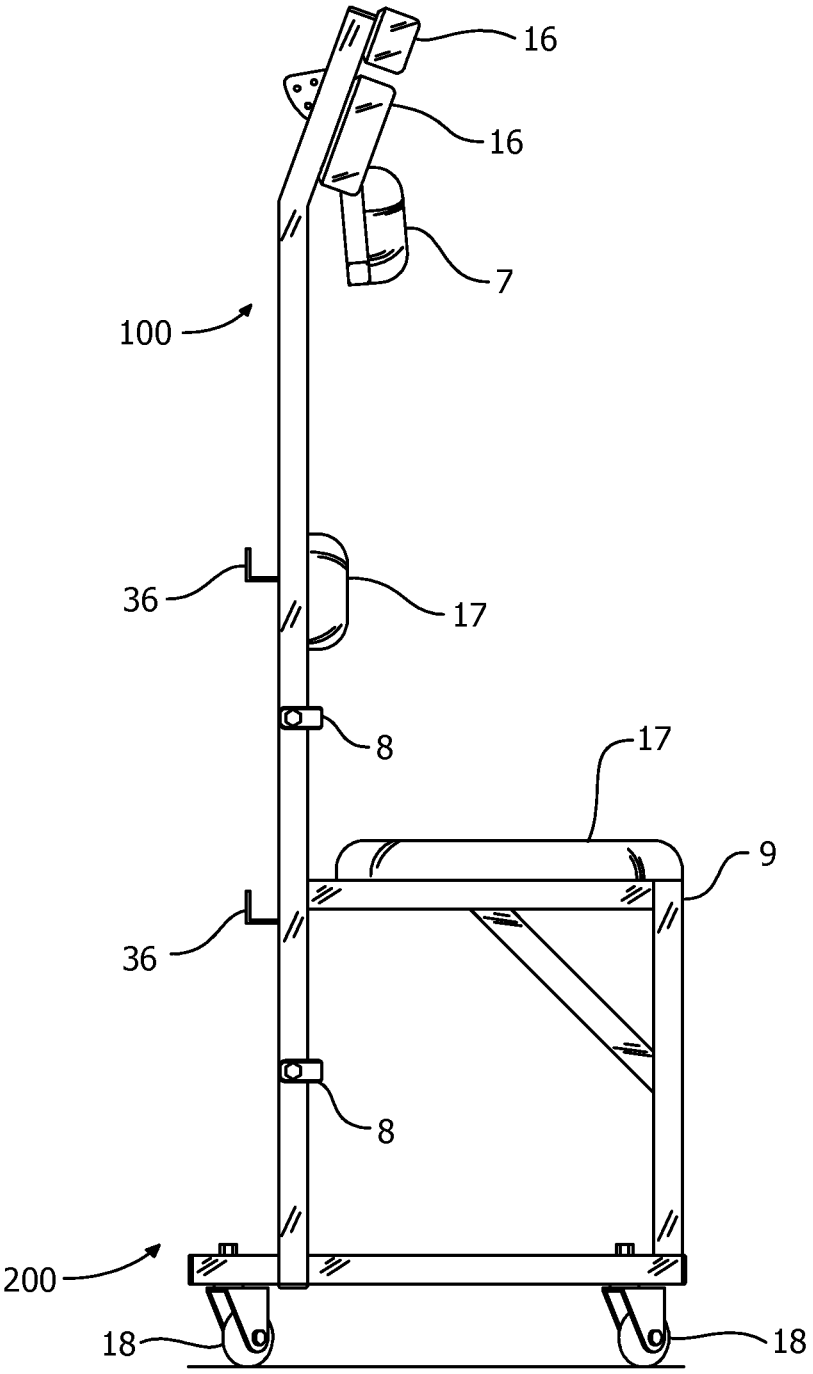
FIG. 26 is a right side view of the mechanics chair with the attachment device attached thereto, according to an embodiment of the invention, wherein the attachment device includes a headrest and a plurality of removable light emitting devices.

In FIGS. 25 and 26, an attachment device 100 with a headrest 7 and removable light emitting devices 16 is shown attached to the mechanics chair 9. In addition, the seat pad 17 of the mechanics chair is depicted in these two figures. Referring to FIG. 26, it can be seen that the base frame of the mechanics chair 9 is provided with a plurality of swiveling wheels 18 (e.g., four wheels 18, with one near each of the respective corners of the base frame). Also, it can be seen that the back side of the mechanics chair 9 is provided with a lower set of hook members 36 and an upper set of hook members 36 for attaching an automotive creeper thereto. The manner in which the hook members 36 are used to attach the creeper to the back side of mechanics chair 9 will be described in further detail hereinafter.

Figure 27:
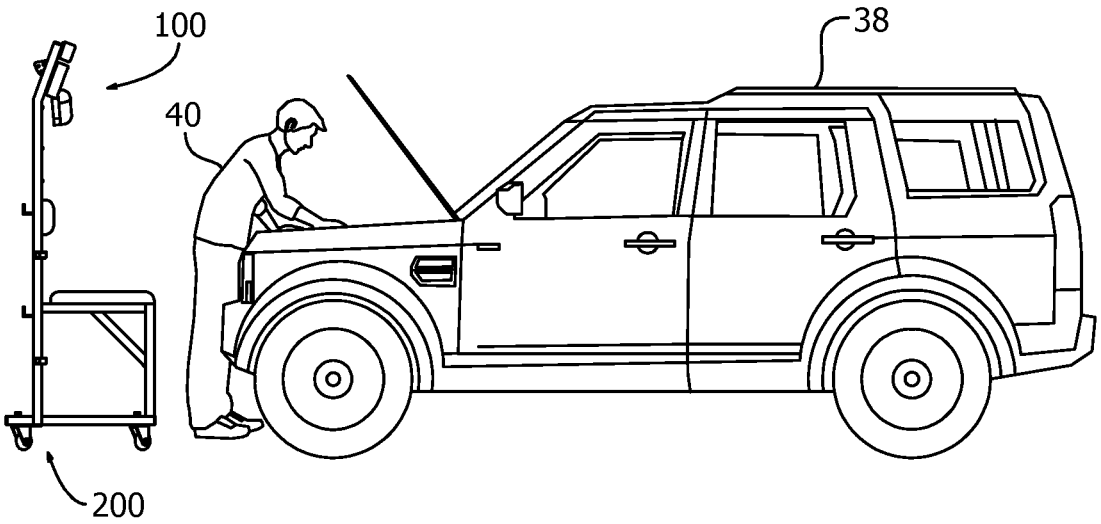
FIG. 27 is another right side view of the mechanics chair with the attachment device attached thereto, according to an embodiment of the invention, wherein the mechanics chair and attachment device assembly is disposed next to a mechanic working under the hood of a vehicle.

Now, referring to FIG. 27, it can be seen that the mechanics chair assembly 200 with the attachment device 100 attached thereto is shown disposed next to a mechanic 40 working under the hood of a vehicle 38. Advantageously, when the mechanics chair assembly 200 and the attachment device 100 are used in this configuration, the light emitting devices 16 disposed at the head end of the attachment device 100 can be used for illuminating the engine compartment of the vehicle 38 so as to facilitate the work being performed on the vehicle 38 by the mechanic 40 (i.e., the light emitting devices 16 provide overhead lighting for the mechanic 40).

Figure 28:
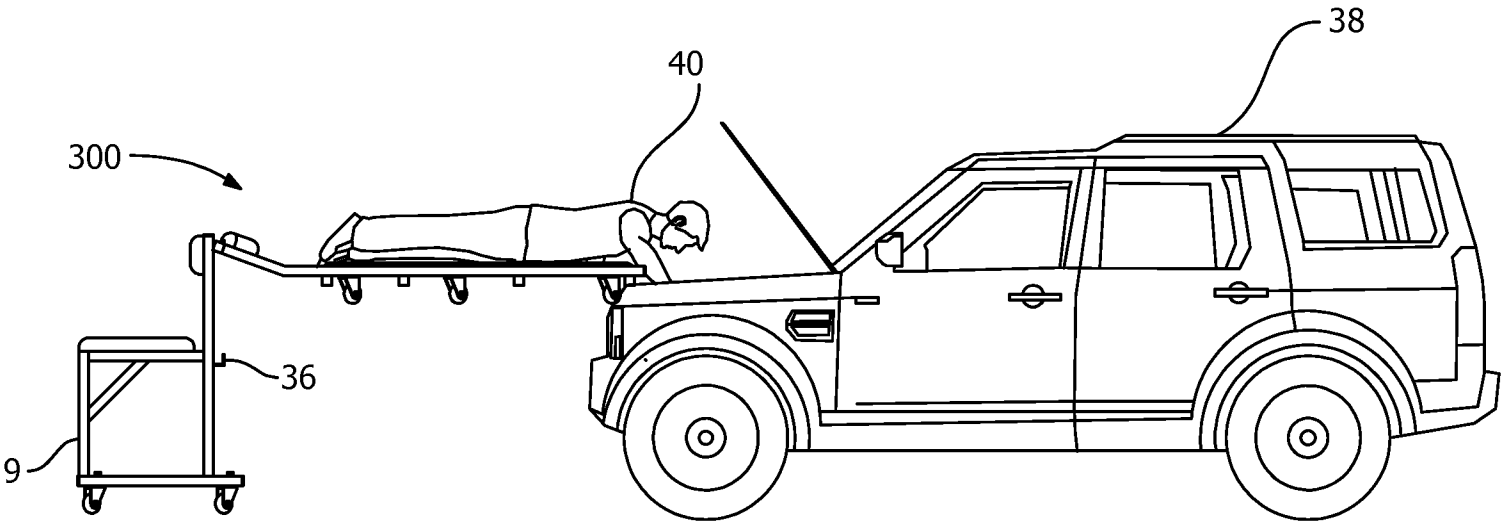
FIG. 28 is a left side view of a mechanics chair with an automotive creeper attached to the top thereof, according to an embodiment of the invention, wherein a head end of the creeper is supported by the mechanics chair and a foot end of the creeper is supported by the front end of a vehicle so that a mechanic can lie on the creeper while working under the hood of the vehicle.

In FIG. 28, an automotive creeper 300 is supported in an elevated, generally horizontal position by the top portion of the mechanics chair 9. Specifically, the head end of the automotive creeper 300 is supported by the upper pair of hook members 36 on the back of the mechanics chair 9, while the foot end of the automotive creeper 300 is supported by the front end of the vehicle 38, namely the front end of the vehicle engine compartment. Advantageously, this configuration of the automotive creeper 300 allows a mechanic 40 to lie down on the elevated creeper 300 while he or she is working under the hood of the vehicle 38, thereby reducing the back fatigue normally experienced by the mechanic 40.

Figure 29:
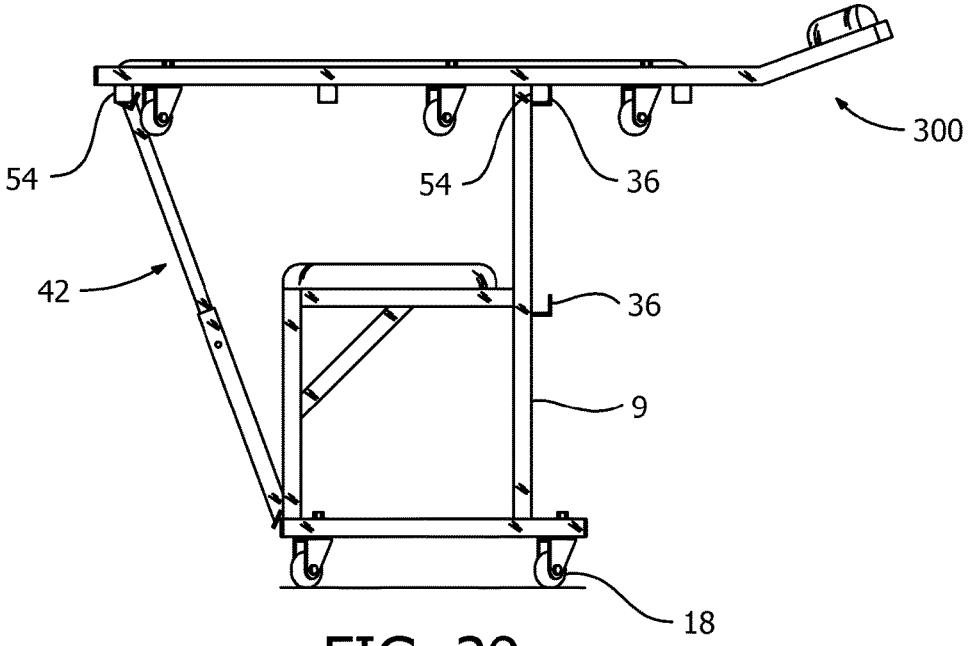
FIG. 29 is a left side view of a mechanics chair with an automotive creeper attached across the top thereof using a diagonally disposed support bar assembly, according to an embodiment of the invention, wherein the automotive creeper on the top of the mechanics chair is configured to be used as a table.
Figure 34:
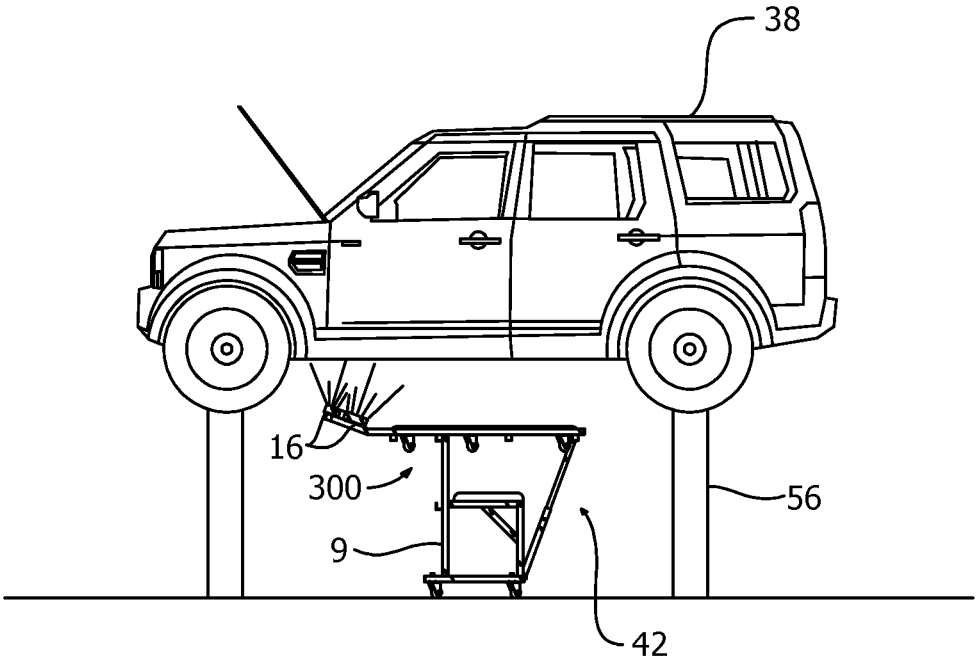
FIG. 34 is a right side view of the mechanics chair and automotive creeper assembly of FIG. 29 disposed underneath a vehicle elevated on a vehicle lift, according to an embodiment of the invention, wherein the automotive creeper on the top of the mechanics chair is configured to be used as a table.

Next, referring to FIG. 29, it can be seen that the automotive creeper 300 may be used as a table when it is attached to the top of the mechanics chair 9. In particular, as illustrated in FIG. 29, a transverse or lateral frame member 54 at the foot end of the automotive creeper 300 is supported from a front base portion of the mechanics chair 9 using an adjustable support bar assembly 42, while a transverse creeper frame member 54 near the middle of the creeper 300 is supported using the top set of hook members 36 on the mechanics chair 9. The configuration illustrated in FIG. 29 allows the chair and creeper assembly 9, 300 to be used as a table for holding tools, etc. Also, it is to be understood that light emitting devices, such as the removable light emitting devices 16, may be placed on the elevated, generally horizontally disposed automotive creeper 300 so that the area underneath a vehicle may be illuminated. For example, as shown in FIG. 34, when a vehicle 38 is elevated on a vehicle lift 56, the automotive creeper 300 may be provided with light emitting devices 16 thereon for illuminating the underside of the vehicle 38, thereby facilitating the work underneath the vehicle 38.

Figure 30:
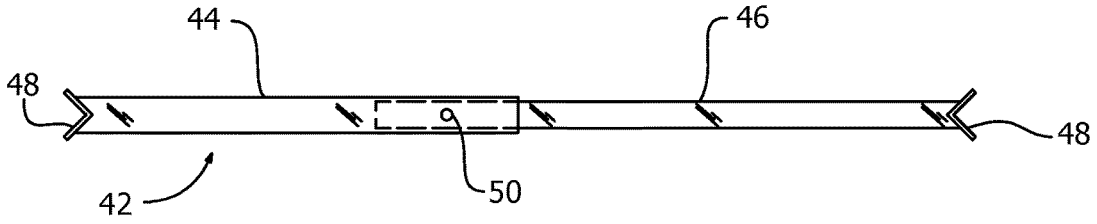
FIG. 30 is a side view of the support bar assembly illustrated in FIG. 29, according to an embodiment of the invention.

The details of the adjustable support bar assembly 42 are illustrated in FIG. 30. With reference to this figure, it can be seen that the adjustable support bar assembly 42 generally comprises a first elongate bar member 44 that is slidably coupled to a second elongate bar member 46 so that the length of the support bar assembly 42 can be selectively adjusted by a user thereof. As shown in FIG. 30, the opposed outer ends of the first and second elongate bar members 44, 46 are each provided with respective angled end cap members 48 for engaging either a transverse frame member 54 of the creeper 300 or a base frame member of the mechanics chair 9. The V-shaped configuration of the end cap members 48 accommodates the diagonal orientation of the support bar assembly 42 when is coupled to the mechanics chair 9 and the automotive creeper 300 (e.g., as shown in FIG. 29). Referring again to FIG. 30, it can be seen that the second elongate bar member 46 has a smaller cross-sectional area than the first elongate bar member 44 so that it is capable of being slidingly received within the inner end of the first elongate bar member 44. As such, the support bar assembly 42 is capable of being adjusted to a desired length by a user thereof. Once the support bar assembly 42 has been adjusted to its desired length by a user, the position of the second inner elongate bar member 46 can be secured in place relative to the first outer elongate bar member 44 by tightening the fastener 50 (e.g., a bolt) against the outer surface of the second inner elongate bar member 46. In this manner, a fixed length of the support bar assembly 42 can be maintained until the fastener 50 is loosened. In one or more embodiments, the first and second elongate bar members 44, 46 may comprise tubular members with a hollow interior.

Figure 31:
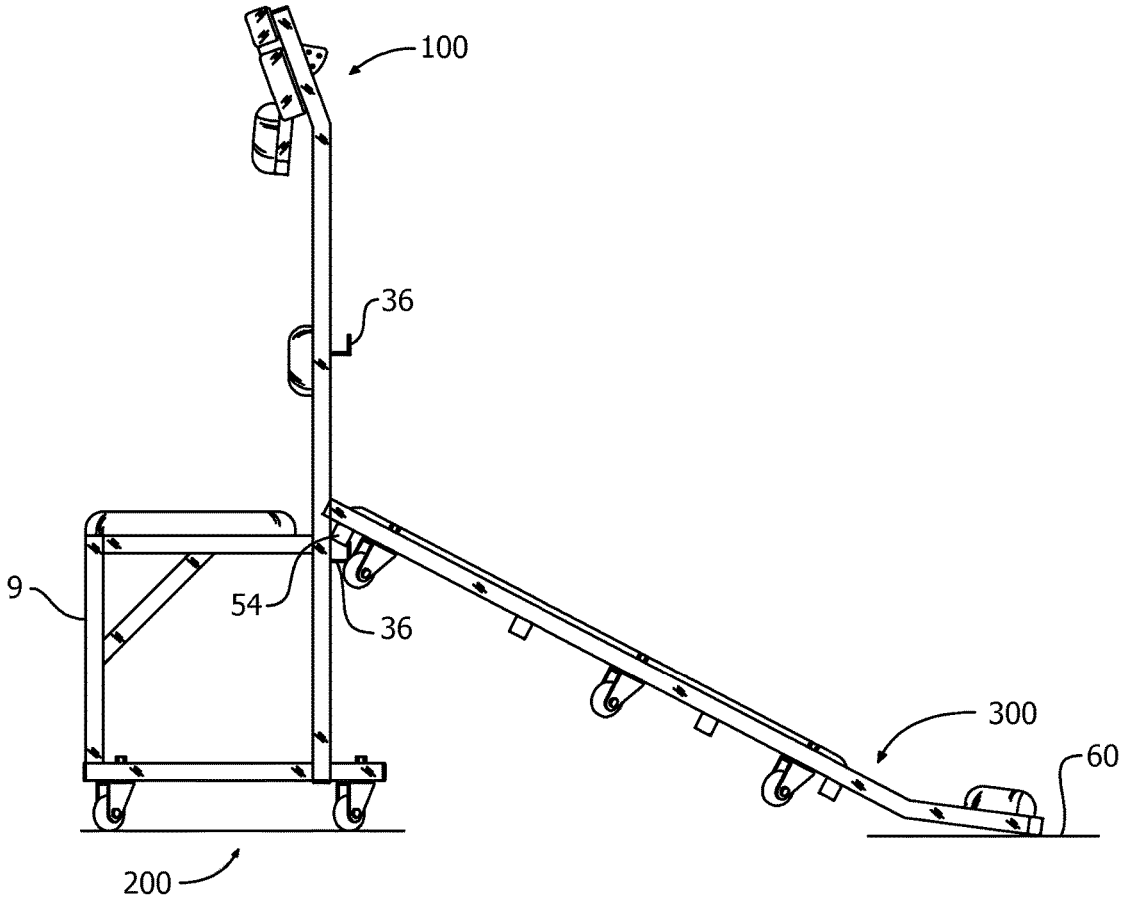
FIG. 31 is a left side view of a mechanics chair with an automotive creeper attached to a back portion thereof in an inclined orientation, according to an embodiment of the invention.

Another possible configuration of the mechanics chair 9 and the automotive creeper 300 is shown in FIG. 31. In this figure, the automotive creeper 300 is disposed in an inclined position with the foot end of the creeper 300 attached to the mechanics chair 9 and the head end of the creeper 300 resting on the ground 60. In particular, a transverse frame member 54 at the foot end of the automotive creeper 300 is engaged with the lower set of hook members 36 on the back of the mechanics chair 9, while the head end of the creeper 300 simply rests on the ground 60. This inclined orientation of the creeper 300 allows a mechanic to be more comfortably supported in an inclined position while he or she is working on a vehicle.

Figure 35:
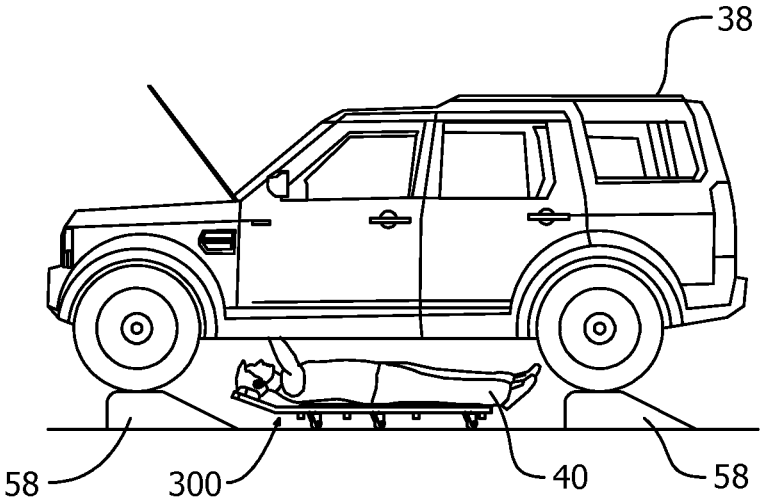
FIG. 35 is a side view of a mechanic working underneath a vehicle, according to an embodiment of the invention, wherein the vehicle is elevated using vehicle wheel ramps.
Figure 36:
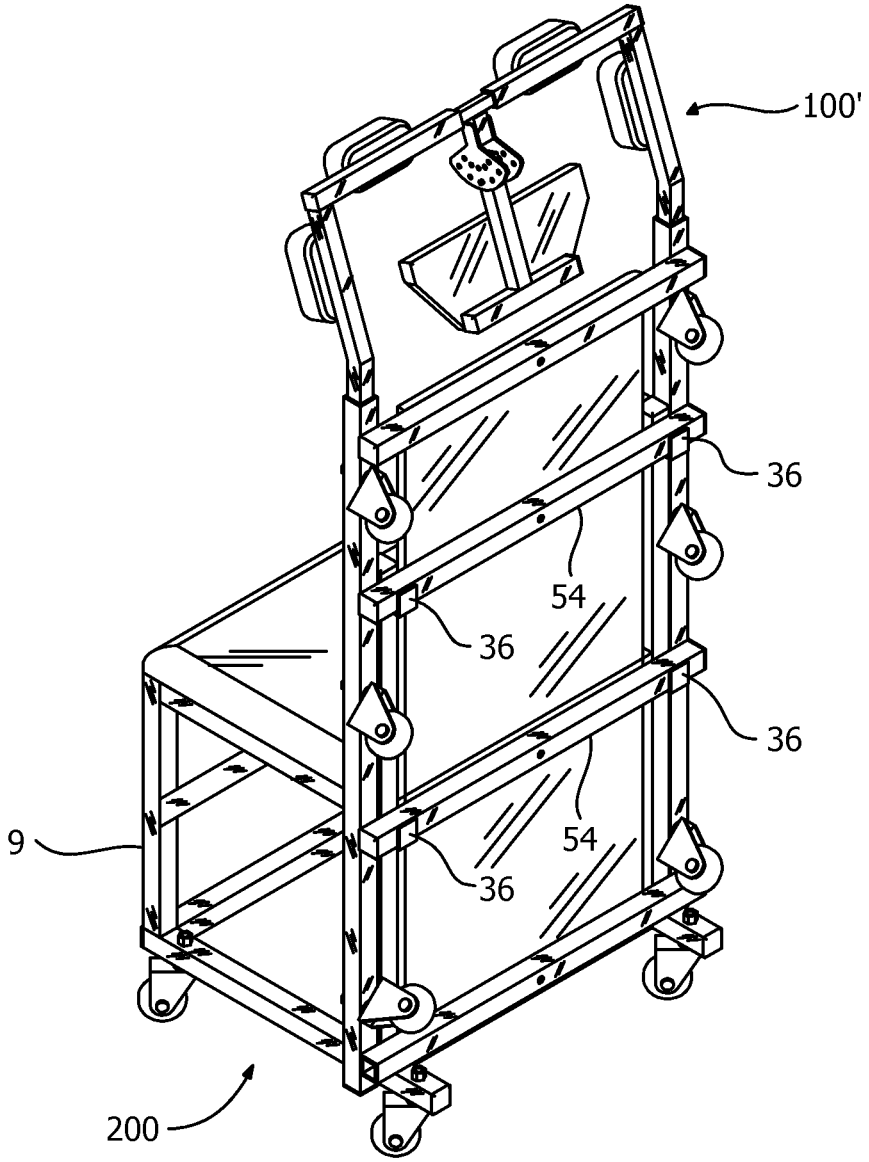
FIG. 36 is a rear perspective view of an automotive creeper attached to the back of a mechanics chair by means of a plurality of hook members disposed on the rear side of the mechanics chair.

FIG. 35 illustrates a mechanic 40 working underneath a vehicle 38 that is elevated on vehicle wheel ramps 58. Similar to that described above in conjunction with FIG. 34, the automotive creeper 300 may be provided with removable light emitting devices 16 disposed thereon for illuminating the underside of the vehicle 38. In FIG. 36, an automotive creeper with an attachment assembly 100' disposed thereon is shown attached to the back of a mechanics chair 9 by means of the hook members 36 disposed on the back side of the mechanics chair 9. In the illustrated embodiment, the hook members 36 are secured to the first and second vertical frame members 30, 31 of the mechanics chair 9. As shown in FIG. 36, a first transverse or lateral frame member 54 of the creeper is detachably coupled to the lower set of hook members 36 on the back of the mechanics chair 9, while a second transverse frame member 54 of the creeper is detachably coupled to the upper set of hook members 36 on the back of the mechanics chair 9. The engagement between the transverse frame members 54 of the automotive creeper and the hook members 36 on the mechanics chair 9 securely couples the automotive creeper to the mechanics chair 9. Although, when it is desired that the creeper be removed from the mechanics chair 9, a user must simply lift the creeper upwardly so that the transverse frame members 54 of the creeper become disengaged from the hook members 36 of the mechanics chair 9.

As described above, one or more embodiments of the invention further include an inventive mechanics chair assembly 200. Advantageously, the attachment device 100, 100', 100" can be removed from the automotive creeper 6 and attached to the mechanics chair 9. The mechanics chair assembly 200 has the rear wheels 18 extended a sufficient distance beyond the back of the chair 9 in order to make the chair 9 less able to be tipped over backwards. It is to be understood that the attachment device 100, 100', 100" can be readily removed from the creeper and attached to the mechanics chair 9. Also, the automotive creeper 300 can be readily attached to the mechanics chair 9. An attachment device 100, 100', 100" or an automotive creeper 300 having light emitting devices 4, 16 can be attached to the mechanics chair 9 so as to provide hands-free light. In this configuration, the light emitting devices 4, 16 move with the mechanic on the mechanics chair 9. The attachment device 100, 100', 100" also doubles as a back support and head pad. This allows for more comfortable, safer work. The attachment device 100, 100', 100" allows the mechanic to lean back to relieve some back/neck fatigue without tipping the chair over backwards. Also, the attachment device 100, 100', 100" can be moved up and down on the mechanics chair 9 for a custom fit and adjustable back/head support.

Figure 32:
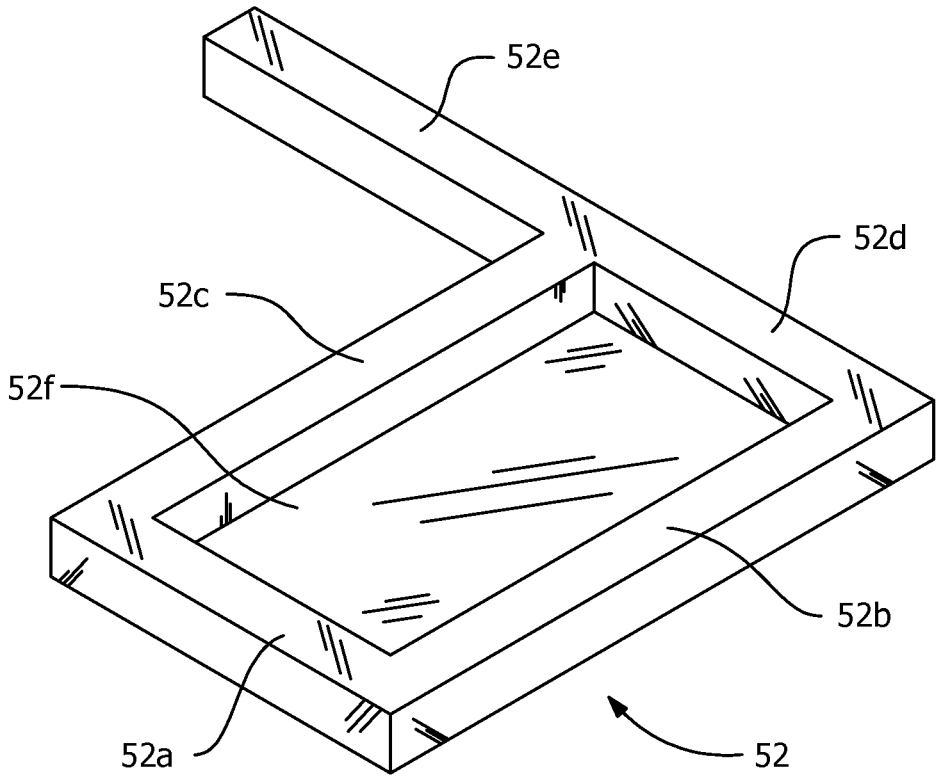
FIG. 32 is a perspective view of a detachable creeper tool tray, according to an embodiment of the invention.
Figure 33:
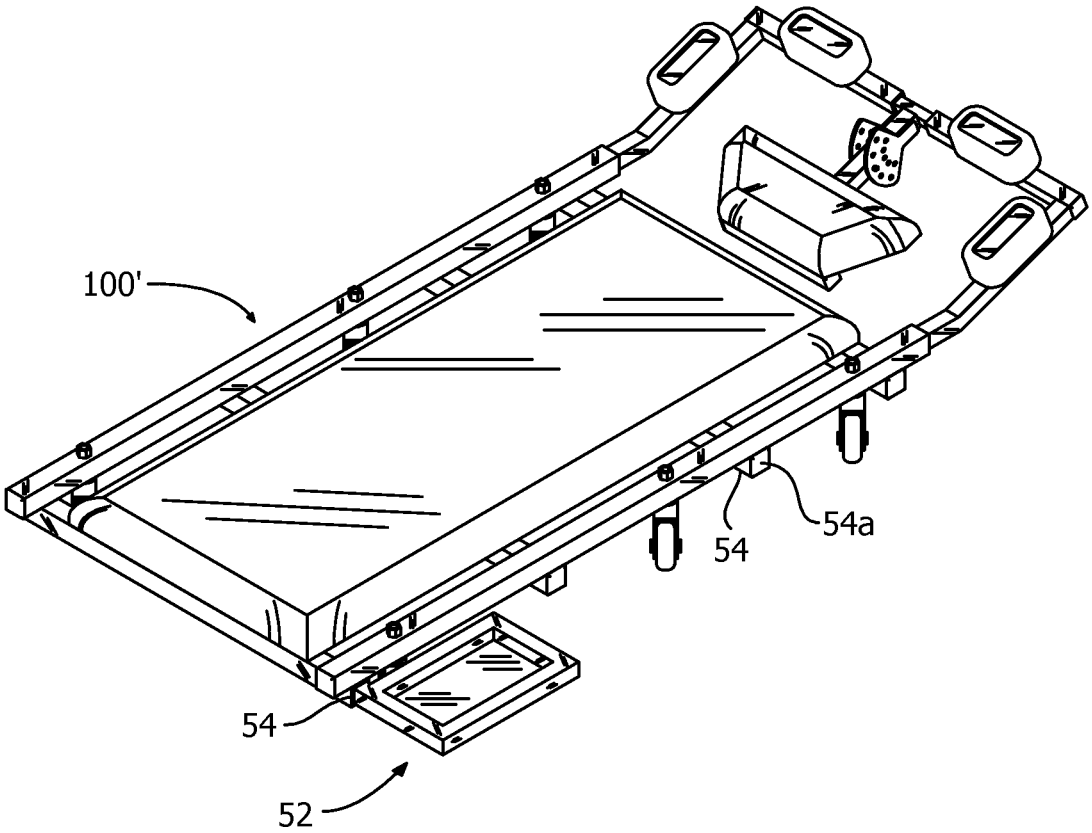
FIG. 33 is a perspective view of the creeper tool tray of FIG. 32 attached to the side of an automotive creeper, according to an embodiment of the invention.

With reference to FIGS. 32 and 33, it can be seen that the automotive creeper with attachment device 100' may be provided with a removable tool tray 52. Referring initially to the perspective view of FIG. 33, it can be seen that the tool tray 52 may be removably coupled to the side of the automotive creeper by inserting an outwardly projecting frame member 52*e* of the tool tray 52 (see FIG. 32) into the open end 54*a* of one of the transverse frame members 54 of the automotive creeper. In FIG. 33, while the tool tray 52 is shown connected to the transverse frame member 54 that is closest to the foot end of the creeper, it is to be understood that the tool tray could also be connected to any of the other three (3) transverse frame member 54 of the creeper depending on the preferential placement of the tool tray 52 by the user (i.e., the mechanic). In order to remove the tool tray 52, a user simply slides the outwardly projecting frame member 52*e* of the tool tray 52 out of the receiving open end 54*a* of the transverse frame member 54. Advantageously, the tool tray 52 can be rotated and installed in different ways to accommodate the user when he or she is lying on the automotive creeper or when he or she is sitting in the mechanics chair 9 with creeper disposed behind him or her.

The details of the removable tool tray 52 are illustrated in FIG. 32. As shown in this figure, the tool tray 52 generally comprises a plurality of frame members 52*a*, 52*b*, 52*c*, 52*d*, 52*e* and a bottom plate member 52*f*. In particular, the tool tray 52 comprises four (4) frame members 52*a*, 52*b*, 52*c*, 52*d* that are arranged in a rectangular configuration. The frame members 52*a*, 52*d* are disposed generally parallel to one another and are respectively located on opposite sides of the bottom plate member 52*f*. Similarly, the frame members 52*b*, 52*c* are disposed generally parallel to one another and are respectively located on opposite sides of the bottom plate member 52*f*. Also, as shown in FIG. 32, each of the frame members 52*a*, 52*d* is disposed generally perpendicular to each of the frame members 52*b*, 52*c* so as to form a rectangular frame circumscribing the rectangular bottom plate 52*f*. With reference again to FIG. 32, it can be seen that the rectangular bottom plate 52*f* is attached to the bottom surfaces of the frame members 52*a*, 52*b*, 52*c*, 52*d*. In the illustrated embodiment of FIG. 32, the outwardly projecting frame member 52*e* is generally co-linear with the side frame member 52*d* (i.e., the projecting frame member 52*e* extends generally linearly outwardly from the end of the frame member 52*d* that engages the frame member 52*c*).

Additional details of the automotive creeper 300 of the illustrated embodiment are shown in FIGS. 37-42. As shown in these figures, the automotive creeper 300 generally comprises a plurality of spaced-apart longitudinal frame members 62 extending in a lengthwise direction of the automotive creeper 300; a plurality of spaced-apart, transverse frame members 54, 66 connected to each of the plurality of spaced-apart longitudinal frame members 62, at least one of the plurality of spaced-apart, transverse frame members 54 including an open end 54*a* (see FIG. 40) that is configured to receive a support member of an automotive creeper accessory device inserted therein (e.g., the outwardly projecting frame member 52*e* of the tool tray 52 in FIG. 43); and a body pad 68 supported on one or more of the plurality of spaced-apart, transverse frame members 54, the body pad 68 configured to accommodate a torso of a user resting thereon (e.g., as shown in FIGS. 28 and 35). As shown in the illustrated embodiment of FIGS. 37 and 39, the body pad 68 may be supported on four (4) of the spaced-apart transverse frame members 54. In an exemplary embodiment, the body pad 68 may comprise an inner foam pad covered with a suitable vinyl covering material (e.g., a marine vinyl material).

Figure 37:
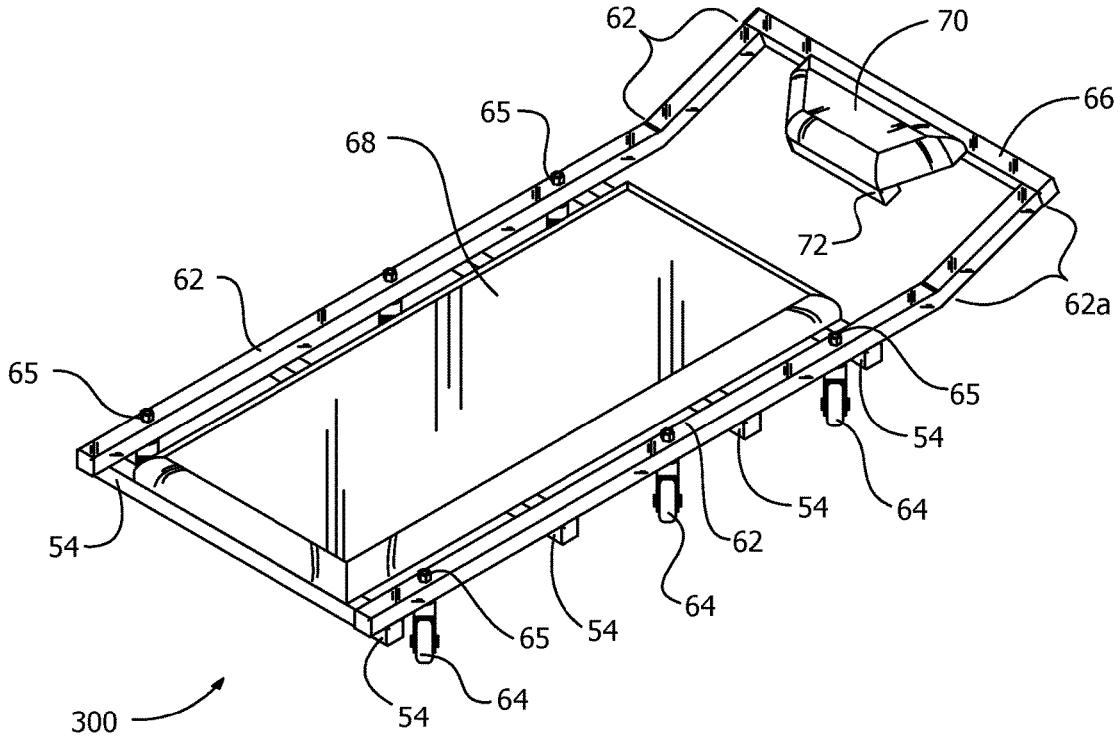
FIG. 37 is a top perspective view of an automotive creeper, according to one embodiment of the invention.
Figure 38:
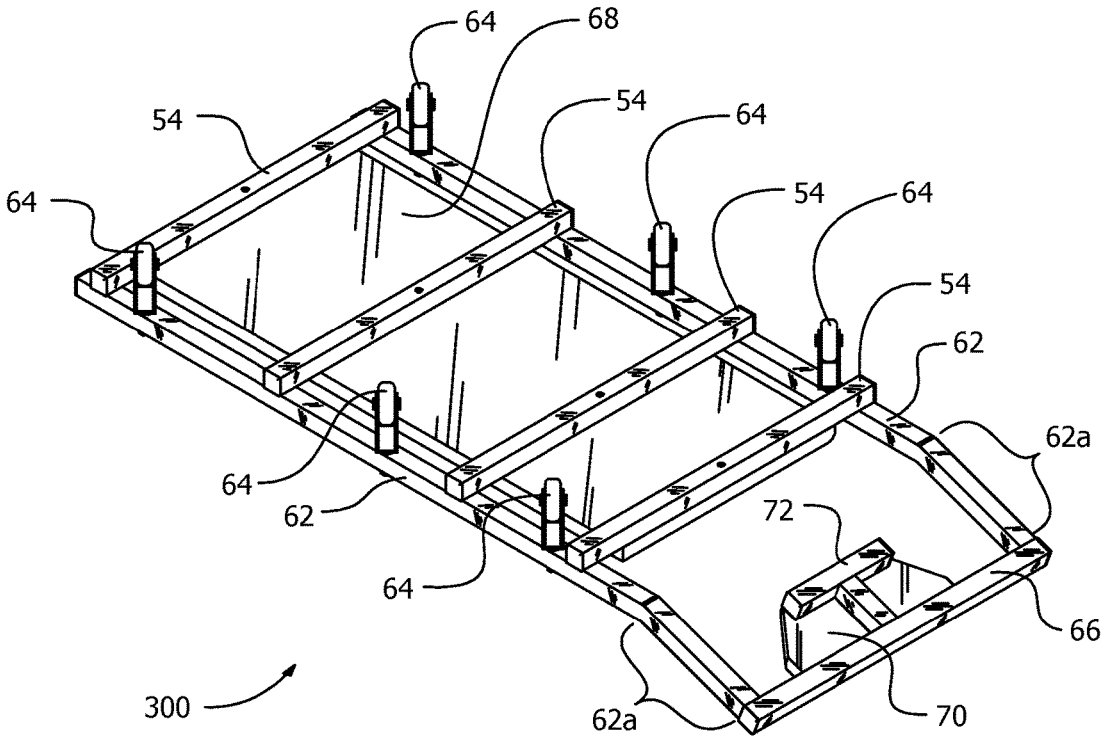
FIG. 38 is a bottom perspective view of the automotive creeper illustrated in FIG. 37.
Figure 39:
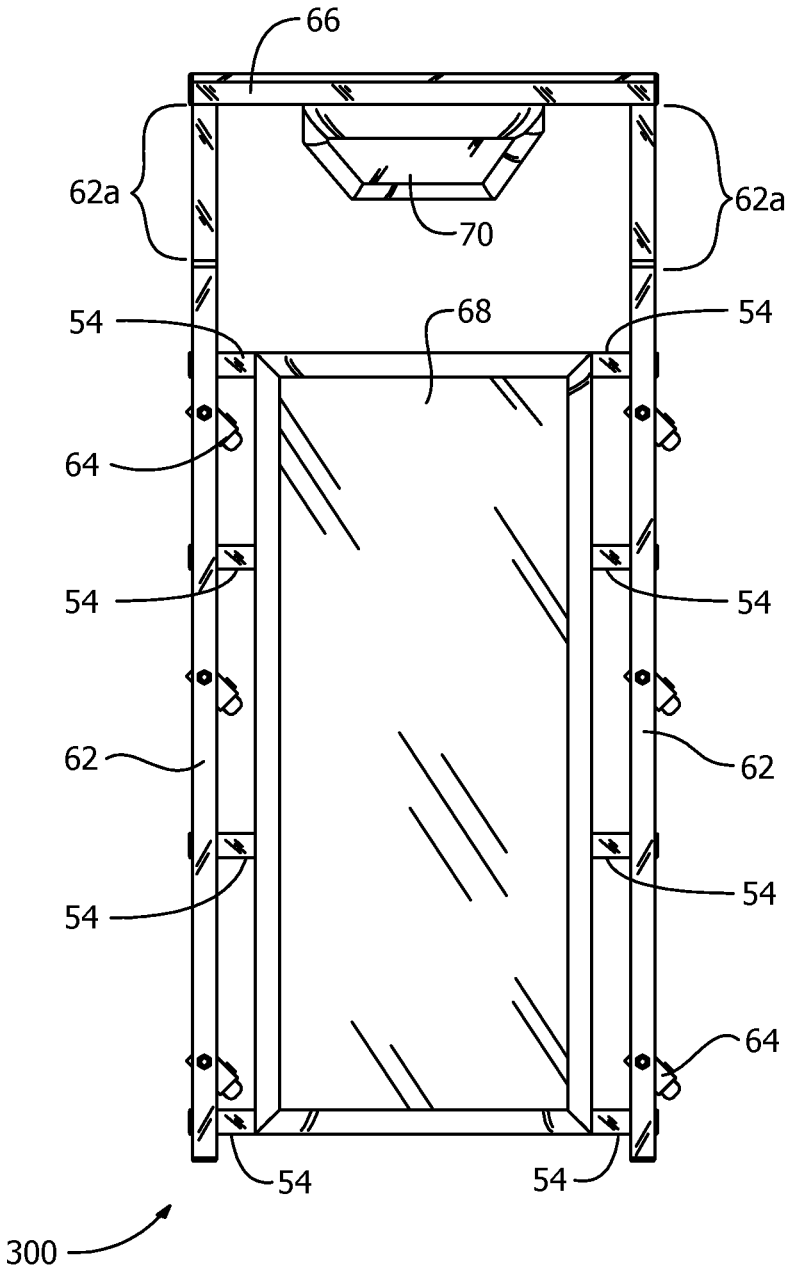
FIG. 39 is a top plan view of the automotive creeper illustrated in FIG. 37.

Referring collectively to FIGS. 37-39, it can be seen that the plurality of spaced-apart longitudinal frame members 62 of the illustrated automotive creeper 300 comprises a first longitudinal side frame member 62 disposed on a left side of the creeper 300 and a second longitudinal side frame member 62 disposed on a right side of the creeper 300. The second longitudinal side member 62 of the automotive creeper 300 is disposed generally opposite to the first longitudinal side member 62 of the automotive creeper 300. Also, with continued reference to FIGS. 37-39, it can be seen that, in the illustrated embodiment, each of the plurality of spaced-apart, transverse frame members 54, 66 is disposed generally perpendicular (or perpendicular) to each of the first and second longitudinal side frame members 62. In the illustrative embodiment, four (4) of the spaced-apart, transverse frame members 54 are disposed underneath the first and second longitudinal side frame members 62 such that the first and second longitudinal side frame members 62 are supported thereon (e.g., a bottom surface of the first and second longitudinal side frame members 62 may be welded to the top surface of each of the four spaced-apart, transverse frame members 54—see FIG. 40). As best shown in the top perspective view of FIG. 37, the plurality of spaced-apart transverse frame members 54, 66 comprises a first transverse frame member 66 disposed at a head end of the automotive creeper 300, a second transverse frame member 54 disposed at a foot end of the automotive creeper 300, and three (3) intermediate transverse frame members 54 disposed between the first transverse frame member 66 and the second transverse frame member 54. The three (3) intermediate transverse frame members 54 and the second transverse frame member 54, which is disposed at the foot end of the automotive creeper 300, are disposed underneath the first and second longitudinal side frame members 62, and are used to support the body pad 68 thereon. As shown in FIGS. 37 and 41, the body pad 68 is recess-mounted between the first and second longitudinal side frame members 62 on the transverse frame members 54 such that the top surface of the body pad 68 is disposed only slightly above the top surfaces of the first and second longitudinal side frame members 62. Turning again to FIG. 37, it can be seen that the first transverse frame member 66 (i.e., the head frame member 66) of the automotive creeper 300 is connected to respective head ends of the first and second longitudinal side frame members 62.

Figure 40:
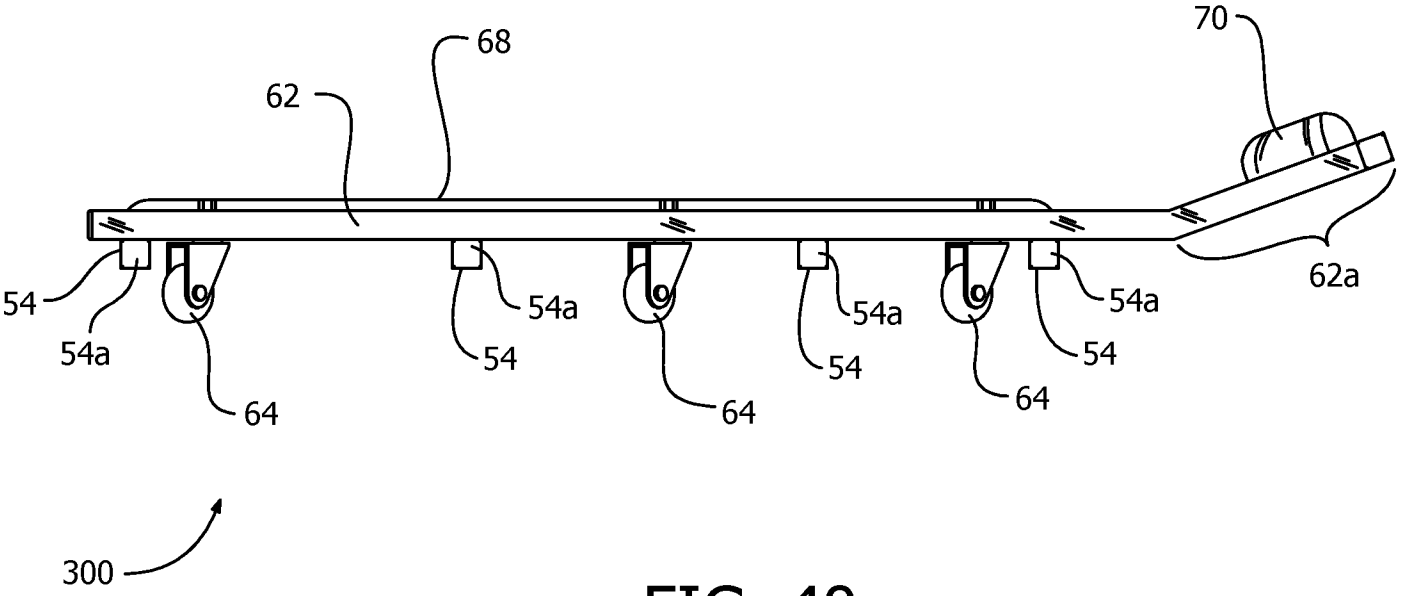
FIG. 40 is a right side view of the automotive creeper illustrated in FIG. 37.
Figure 41:
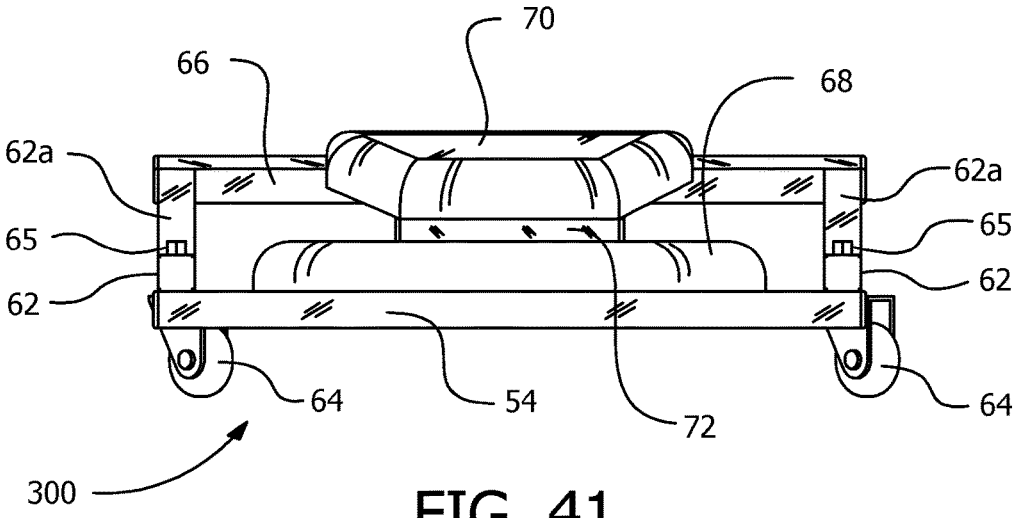
FIG. 41 is a rear end view of the automotive creeper illustrated in FIG. 37.
Figure 42:
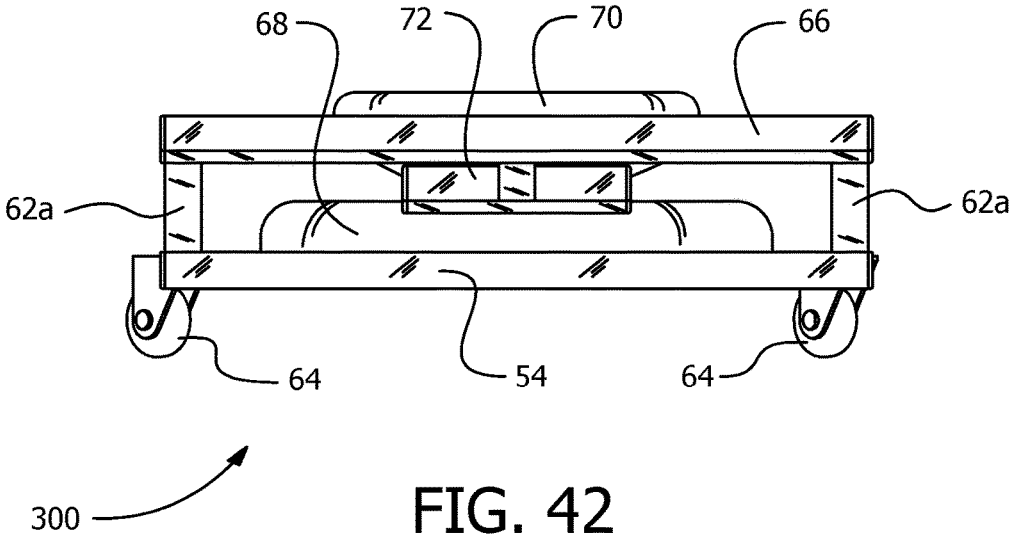
FIG. 42 is a front end view of the automotive creeper illustrated in FIG. 37.

In the illustrated embodiment, as shown in FIGS. 37-42, the automotive creeper 300 comprises a headrest 70 supported on a generally T-shaped member 72 (i.e., a T-bar headrest support). As best shown in the bottom perspective view of FIG. 38, the generally T-shaped member 72 is attached to the first transverse frame member 66 at the head end of the automotive creeper 300 (e.g., the first end of a base portion 72*a* of the generally T-shaped member 72 may be welded to the side of the transverse frame member 66). Also, as best illustrated in the perspective view of FIG. 44, the generally T-shaped member 72 comprises the base portion 72*a* with its first end affixed to the side of the transverse frame member 66, and a crossbar portion 72*b* mounted to the second end of the base portion 72*a*. Advantageously, the T-shaped configuration of the generally T-shaped member 72 mounts the headrest 70 to the transverse frame member 66 in a secure and efficient manner (i.e., the T-shape minimizes the amount of frame material that is required). In one or more embodiments, an angle of the headrest may be selectively adjustable by a user (e.g., as shown in FIG. 36, the headrest may be mounted to the head frame member of the creeper using an adjustable hinge so that the headrest may be adjusted up and down). Also, as illustrated in FIGS. 37, 38, and 40, the first and second longitudinal side frame members 62 are each bent at an angle near the head end of the automotive creeper 300 (i.e., each longitudinal side frame member 62 is provided with a respective inclined portion 62*a*) so as to accommodate an inclined head position of the user disposed on the automotive creeper 300, thereby increasing user comfort by more ergonomically accommodating the head of the user. In an exemplary embodiment, the head pad of the headrest 70 may comprise an inner foam pad covered with a suitable vinyl covering material (e.g., a marine vinyl material).

Referring to FIGS. 37-42, it can be seen that each of the first and second longitudinal side frame members 62 comprises a plurality of swiveling wheels 64 coupled thereto (e.g., three (3) swiveling wheels 64 on each of the first and second longitudinal side frame members 62). As best shown in the top perspective view of FIG. 37, each of the swiveling wheels 64 is secured to the longitudinal side frame members 62 of the automotive creeper 300 by a fastener device (i.e., a shank bolt secured by a nut 65 disposed on the top surface of the longitudinal side frame members 62). Advantageously, the plurality of swiveling wheels 64 allow the automotive creeper 300 to be rolled along the ground with ease.

Similar to that described above in conjunction with the attachment device 100, the automotive creeper may comprise a plurality of light emitting devices for providing light to an area of a vehicle being serviced. For example, as shown in FIG. 33, the automotive creeper may be provided with a plurality of removable light emitting devices near the headrest (similar to the light emitting devices 16 described above). In one or more embodiments, the removable light emitting devices may comprise removable, magnetically-attached LED lights that can be selectively positioned on the head frame member and the longitudinal side frame members of the automotive creeper. Preferably, the head frame member and the longitudinal side frame members of the automotive creeper are formed from a metallic material (e.g., a lightweight, but strong steel), so that the magnet(s) on the back of each LED light is readily attracted to the outer surfaces of the members.

Figure 43:
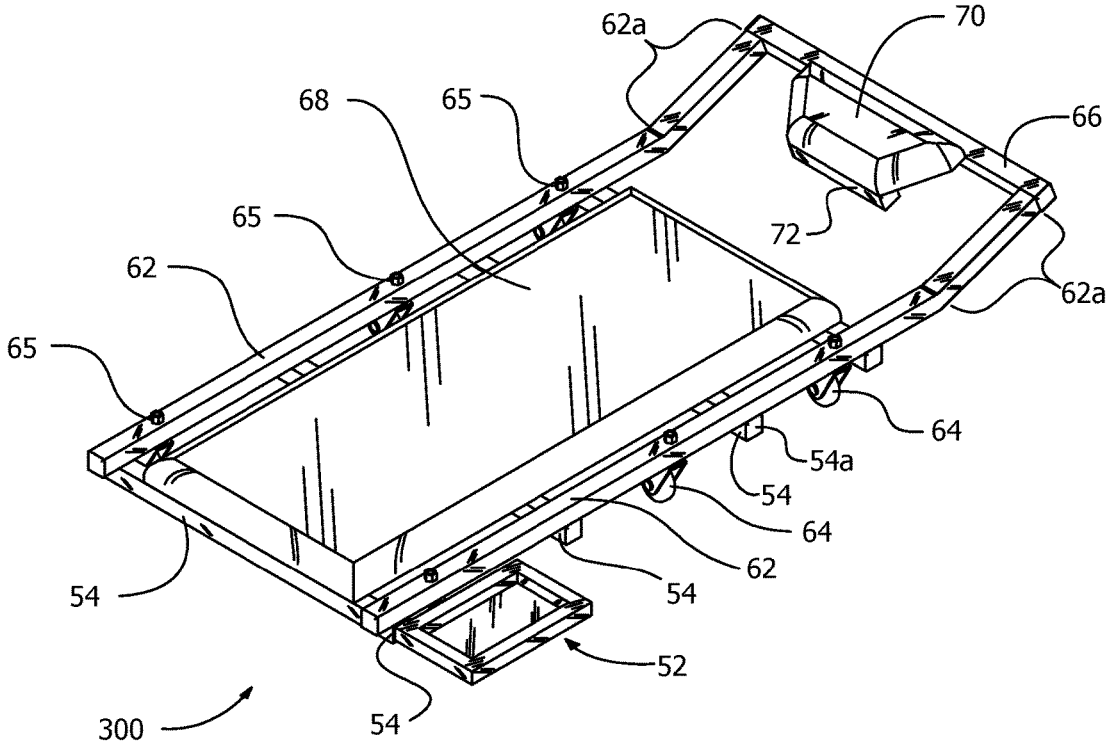
FIG. 43 is another top perspective view of the automotive creeper illustrated in FIG. 37, wherein the creeper tool tray of FIG. 32 is shown attached to the side of the automotive creeper.

As described above with regard to the automotive creeper of FIG. 33, the automotive creeper 300 may comprise a tool tray 52 with an outwardly extending frame member 52*e* that is removably attached to the automotive creeper 300 (see FIG. 43). In FIG. 43, it can be seen that the open end 54*a* of the transverse frame member 54 at the foot end of the automotive creeper 300 receives a portion of the outwardly extending frame member 52*e* of the tool tray 52 therein so that the tool tray is capable of being detachably coupled to the automotive creeper 300. The structural components of the tool tray 52, which is illustrated in FIG. 43, are the same as that described above with regard to FIG. 32. In the illustrated embodiment, because each of the four (4) transverse frame members 54 has an open end 54*a*, the tool tray 52 may be selectively positioned by the user on any one of the four (4) transverse frame members 54 so that the tool tray 52 may be located in a position that is most convenient for the particular vehicle task being performed by the user. In the illustrated embodiment, the interior of each of the four (4) transverse frame members 54 is unobstructed (i.e., contains no fasteners, etc. therein) so that the outwardly extending frame member 52*e* of the tool tray 52 can be fully inserted into any one of the four (4) transverse frame members 54.

Figure 44:
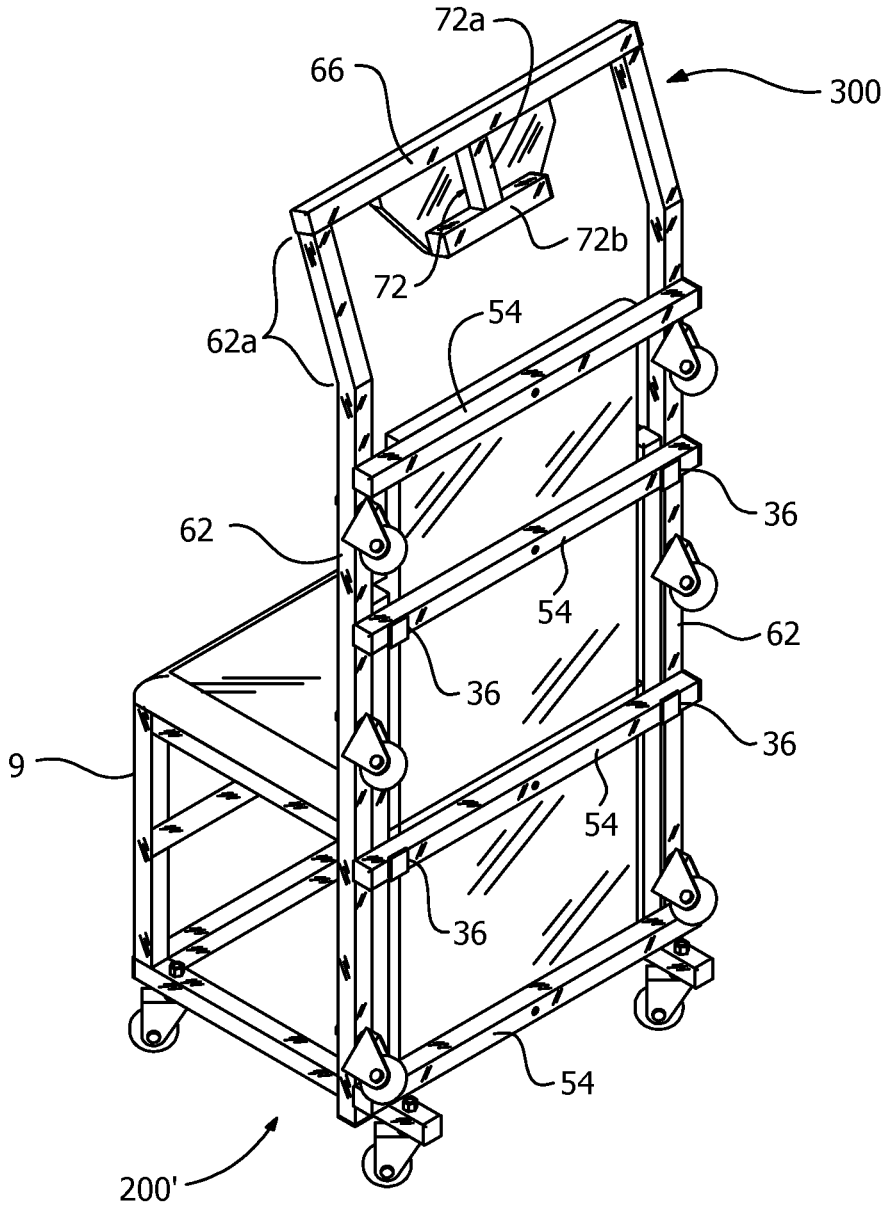
FIG. 44 is a rear perspective view of the automotive creeper of FIG. 37 attached to the back of a mechanics chair by means of a plurality of hook members disposed on the rear side of the mechanics chair.

Now, turning to the illustrative embodiment of FIG. 44, it can be seen that the automotive creeper 300 is shown attached to the seat back portion of the mechanics chair 9 by means of two (2) pairs of laterally spaced-apart hook members 36. The manner in which the hook members 36 of the mechanics chair assembly 200' of FIG. 44 attach the automotive creeper 300 to the mechanics chair 9 is generally the same as that described above in conjunction with FIG. 36.

Figure 45:
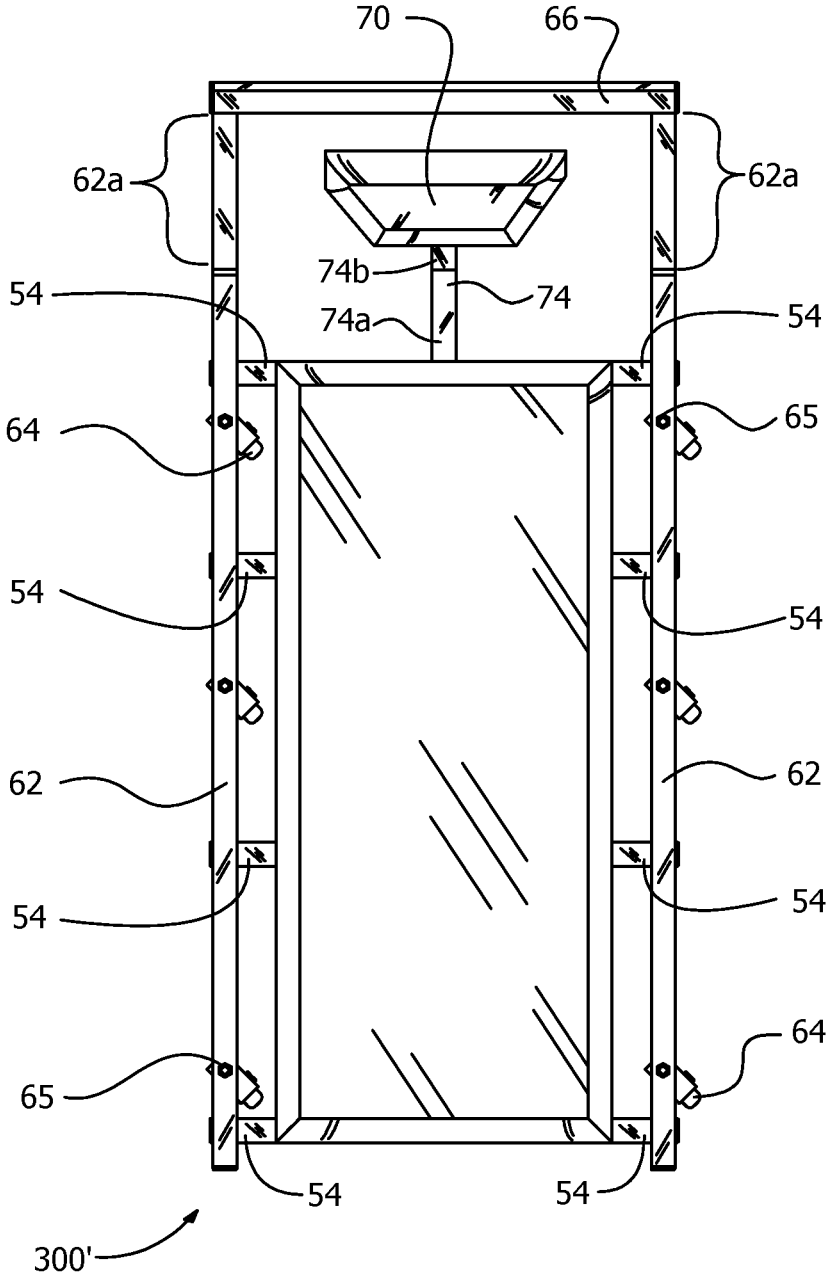
FIG. 45 is a top perspective view of an automotive creeper, according to another embodiment of the invention, wherein the headrest assembly is attached to a transverse frame member of the automotive creeper disposed underneath the body pad of the creeper.

Next, referring to FIG. 45, an alternative embodiment 300' of the automotive creeper will now be described. Referring to this figure, it can be seen that, in most respects, the embodiment 300' of the automotive creeper of FIG. 45 is similar to that of the preceding embodiment of the automotive creeper 300 illustrated in FIGS. 37-42. Moreover, many elements are common to both such embodiments. For the sake of brevity, the elements that the automotive creeper 300' has in common with the aforedescribed automotive creeper 300 will not be discussed because these components have already been explained in detail above. Furthermore, in the interest of clarity, these elements are denoted using the same reference characters that were used in the preceding embodiment.

In the alternative embodiment of FIG. 45, the headrest 70 of the automotive creeper 300' is mounted to one of the intermediate transverse frame members 54, rather to than the transverse frame member 66 disposed at the head end of the creeper, as was described above for the automotive creeper 300. More particularly, as shown in FIG. 45, the headrest 70 is mounted to the side of the intermediate transverse frame member 54, which is disposed closest to the head end of the creeper 300', by means of headrest bar 74 (e.g., the end of the headrest bar 74 may be welded to the side of the intermediate transverse frame member 54). As shown in this figure, the headrest bar 74 comprises a straight bar portion 74*a* extending from the side of the intermediate transverse frame member 54 and a inclined bar portion 74*b* connecting the head pad of the headrest 70 to the straight bar portion 74*a*. Similar to that described above for the first and second longitudinal side frame members 62 of the creeper 300, inclined bar portion 74*b* of the headrest bar 74 is bent upwardly at an angle so that the headrest 70 is inclined for maximizing the comfort of the user (i.e., the headrest 70 is disposed at generally the same angle as the headrest of the creeper 300 illustrated in FIGS. 37-42).

It is readily apparent that the aforedescribed automotive creeper 300, 300' offers numerous advantages. For example, the automotive creeper 300, 300' is ergonomically designed so as to enhance the comfort of a user while he or she is working on a vehicle. As another example, the automotive creeper 300, 300' is readily capable of accommodating accessory devices, such as a headrest and/or lights. In addition, the mechanics chair 9, which may be used in conjunction with the automotive creeper 300, 300', does not easily tip over, and provides increased back and neck support during use so that user fatigue and discomfort can be minimized during vehicle repairs.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. An automotive creeper comprising, in combination:

an automotive creeper accessory device, said automotive creeper accessory device including an outwardly extending frame member;

a plurality of spaced-apart longitudinal frame members extending in a lengthwise direction of said automotive creeper;

a plurality of spaced-apart, transverse frame members connected to each of said plurality of spaced-apart longitudinal frame members, at least one of said plurality of spaced-apart, transverse frame members including an open end, said open end of said at least one of said plurality of spaced-apart, transverse frame members configured to receive a portion of said outwardly extending frame member of said automotive creeper accessory device therein so that said automotive creeper accessory device is capable of being detachably coupled to said automotive creeper; and a body pad supported on one or more of said plurality of spaced-apart, transverse frame members, said body pad configured to accommodate a torso of a user resting thereon.

2. The automotive creeper according to claim 1, wherein said plurality of spaced-apart longitudinal frame members comprises a first longitudinal side frame member and a second longitudinal side frame member, said second longitudinal side member of said automotive creeper being disposed generally opposite to said first longitudinal side member of said automotive creeper.

3. The automotive creeper according to claim 2, wherein each of said plurality of spaced-apart, transverse frame members is disposed generally perpendicular to said first longitudinal side frame member and said second longitudinal side member.

4. The automotive creeper according to claim 2, wherein at least some of said plurality of spaced-apart, transverse frame members are disposed underneath said first and second longitudinal side frame members such that said first and second longitudinal side frame members are supported thereon.

5. The automotive creeper according to claim 2, wherein said plurality of spaced-apart transverse frame members comprises a first transverse frame member disposed at a head end of said automotive creeper, a second transverse frame member disposed at a foot end of said automotive creeper, and one or more intermediate transverse frame members disposed between said first transverse frame member and said second transverse frame member, and wherein said first transverse frame member is connected to respective head ends of said first and second longitudinal side frame members.

6. The automotive creeper according to claim 5, further comprising a headrest supported on a generally T-shaped member, said generally T-shaped member being attached to said first transverse frame member at said head end of said automotive creeper.

7. The automotive creeper according to claim 6, wherein an angle of said headrest is selectively adjustable by a user.

8. The automotive creeper according to claim 5, wherein said first and second longitudinal side frame members are each upwardly bent at an angle near said head end of said automotive creeper so as to accommodate an inclined head position of said user disposed on said automotive creeper.

9. The automotive creeper according to claim 2, wherein each of said first and second longitudinal side frame members comprises one or more wheels coupled thereto, said one or more wheels configured to allow said automotive creeper to be rolled along the ground.

10. The automotive creeper according to claim 1, further comprising one or more light emitting devices for providing light to an area of a vehicle being serviced.

11. The automotive creeper according to claim 10, wherein said one or more light emitting devices comprise light emitting diode (LED) lamps.

12. The automotive creeper according to claim 1, wherein said automotive creeper accessory device is in the form of a tool tray.

13. An automotive creeper comprising, in combination:

a plurality of spaced-apart longitudinal frame members extending in a lengthwise direction of said automotive creeper, said plurality of spaced-apart longitudinal frame members including a first longitudinal side frame member and a second longitudinal side frame member, said second longitudinal side member of said automotive creeper being disposed generally opposite to said first longitudinal side member of said automotive creeper;

a plurality of spaced-apart, transverse frame members connected to each of said plurality of spaced-apart longitudinal frame members, said plurality of spaced-apart transverse frame members including a first transverse frame member disposed at a head end of said automotive creeper, a second transverse frame member disposed at a foot end of said automotive creeper, and one or more intermediate transverse frame members disposed between said first transverse frame member and said second transverse frame member, said first transverse frame member being connected to respective head ends of said first and second longitudinal side frame members, and at least one of said plurality of spaced-apart, transverse frame members including an open end that is configured to receive a support member of an automotive creeper accessory device inserted therein;

a body pad supported on one or more of said plurality of spaced-apart, transverse frame members, said body pad configured to accommodate a torso of a user resting thereon; and a headrest supported on a generally T-shaped member, said generally T-shaped member being attached to said first transverse frame member at said head end of said automotive creeper.

14. A mechanics chair, comprising:

a mechanics chair that includes:

a seat portion, said seat portion including a plurality of seat members, a first of said plurality of seat members being laterally spaced apart from a second of said plurality of seat members;

a seat back portion coupled to said seat portion, said seat back portion including a plurality of seat back members, a first of said plurality of seat back members being laterally spaced apart from a second of said plurality of seat back members;

a base portion, said base portion including a plurality of base members, a first of said plurality of base members being laterally spaced apart from a second of said plurality of base members, at least one of said plurality of base members extending beyond said seat back portion of said mechanics chair so as to prevent the tipping thereof; and a leg structure coupling said seat portion to said base portion, said leg structure including a plurality of generally vertical leg members, each of said plurality of generally vertical leg members spaced apart from one another, a first of said plurality of generally vertical leg members coupling said first of said plurality of base members to said first of said plurality of seat members, and a second of said plurality of generally vertical leg members coupling said second of said plurality of base members to said second of said plurality of seat members; and an automotive creeper coupled to said seat back portion of said mechanics chair by means of at least one pair of laterally spaced-apart hook members, a first of said at least one pair of hook members being attached to said first of said plurality of seat back members, and a second of said at least one pair of hook members being attached to said second of said plurality of seat back members, said automotive creeper including:

a plurality of spaced-apart longitudinal frame members extending in a lengthwise direction of said automotive creeper;

a plurality of spaced-apart, transverse frame members connected to each of said plurality of spaced-apart longitudinal frame members; and a body pad supported on one or more of said plurality of spaced-apart, transverse frame members, said body pad configured to accommodate a torso of a user resting thereon;

wherein said at least one pair of hook members is coupled to a first one of said plurality of spaced-apart, transverse frame members of said automotive creeper.

15. The mechanics chair assembly according to claim 14, wherein said plurality of seat members comprise a first pair of seat side members and a second pair of transverse seat members, said seat side members being spaced apart from one another by the length of said transverse seat members; and wherein each of said seat side members is disposed generally perpendicular to each of said transverse seat members.

16. The mechanics chair assembly according to claim 14, wherein said plurality of seat back members comprise a pair of seat back side members and a transverse seat back member, said seat back side members being spaced apart from one another by the length of said transverse seat back member; and wherein each of said seat back side members is disposed generally perpendicular to said transverse seat back member.

17. The mechanics chair assembly according to claim 14, wherein said plurality of base members comprises a pair of base side members and a transverse base member, said base side members being spaced apart from one another by the length of said transverse base member; wherein each of said base side members is disposed generally perpendicular to said transverse base member; and wherein each of said base side members comprises a plurality of wheels coupled thereto, at least one of said plurality of wheels on said each base side member being disposed rearwardly of said seat back portion of said mechanics chair so as to prevent the tipping thereof.

18. The mechanics chair assembly according to claim 14, further comprising a pair of diagonal members, a first of said pair of said diagonal members coupling said first of said plurality of generally vertical leg members to said first of said plurality of seat members, and a second of said pair of said diagonal members coupling said second of said plurality of generally vertical leg members to said second of said plurality of seat members; and wherein said seat portion of said mechanics chair further comprises a padded seat.

19. The mechanics chair assembly according to claim 14, further comprising a support bar subassembly configured to support one end of said automotive creeper when said automotive creeper is disposed in a generally horizontal position on said mechanics chair, said support bar subassembly configured to extend diagonally from one of said plurality of base members of said mechanics chair to a second one of said plurality of spaced-apart, transverse frame members of said automotive creeper.

20. The mechanics chair assembly according to claim 14, wherein at least one of said plurality of spaced-apart, transverse frame members of said automotive creeper includes an open end that is configured to receive a support member of an automotive creeper accessory device inserted therein.

21. A mechanics chair assembly, comprising:

a mechanics chair that includes:

a seat portion, said seat portion including a plurality of seat members;

a seat back portion coupled to said seat portion, said seat back portion including a plurality of seat back members;

a base portion, said base portion including a plurality of base members, at least one of said plurality of base members extending beyond said seat back portion of said mechanics chair so as to prevent the tipping thereof; and a leg structure coupling said seat portion to said base portion, said leg structure including a plurality of leg members, each of said plurality of leg members spaced apart from one another; and an automotive creeper attachable to said seat back portion of said mechanics chair, said automotive creeper including:

a plurality of spaced-apart longitudinal frame members extending in a lengthwise direction of said automotive creeper;

a plurality of spaced-apart, transverse frame members connected to each of said plurality of spaced-apart longitudinal frame members; and a body pad supported on one or more of said plurality of spaced-apart, transverse frame members, said body pad configured to accommodate a torso of a user resting thereon;

wherein, when attached to said mechanics chair, said automotive creeper is configured to form an upper seat back support portion of said mechanics chair.

* * * * *